US010805727B2

(12) United States Patent
Murata et al.

(10) Patent No.: US 10,805,727 B2
(45) Date of Patent: Oct. 13, 2020

(54) FILTER GENERATION DEVICE, FILTER GENERATION METHOD, AND PROGRAM

(71) Applicant: JVCKENWOOD Corporation, Yokohama-shi, Kanagawa (JP)

(72) Inventors: Hisako Murata, Yokohama (JP); Takahiro Gejo, Yokohama (JP); Yumi Fujii, Yokohama (JP); Kuniaki Takachi, Yokohama (JP); Masaya Konishi, Yokohama (JP)

(73) Assignee: JVCKENWOOD Corporation, Yokohama-Shi, Kanagawa (JP)

( * ) Notice: Subject to any disclaimer, the term of this patent is extended or adjusted under 35 U.S.C. 154(b) by 0 days.

(21) Appl. No.: 16/549,928

(22) Filed: Aug. 23, 2019

(65) Prior Publication Data

US 2019/0379975 A1 Dec. 12, 2019

Related U.S. Application Data

(63) Continuation of application No. PCT/JP2018/003975, filed on Feb. 6, 2018.

(30) Foreign Application Priority Data

Feb. 24, 2017 (JP) ..... 2017-033204
Sep. 25, 2017 (JP) ..... 2017-183337

(51) Int. Cl.
*H04R 3/04* (2006.01)
*H04S 7/00* (2006.01)
*H04R 29/00* (2006.01)

(52) U.S. Cl.
CPC ..... *H04R 3/04* (2013.01); *H04R 29/004* (2013.01); *H04S 7/306* (2013.01)

(58) Field of Classification Search
CPC . H04R 3/00; H04R 3/005; H04R 3/04; H04R 3/10; H04R 5/027; H04R 29/004;
(Continued)

(56) References Cited

U.S. PATENT DOCUMENTS

2003/0215104 A1* 11/2003 Yamada ..... H04S 1/005 381/309
2005/0195990 A1* 9/2005 Kondo ..... G10L 21/0272 381/92

(Continued)

FOREIGN PATENT DOCUMENTS

JP 2008-512015 A 4/2008
WO 2006/024850 A2 3/2006

*Primary Examiner* — Thang V Tran
(74) *Attorney, Agent, or Firm* — Procopio, Cory, Hargreaves & Savitch LLP

(57) ABSTRACT

A processor of a filter generation device according to an embodiment includes an extraction unit that extracts a first signal having a first number of samples from samples preceding a boundary sample of a sound pickup signal, a signal generation unit that generates a second signal containing a direct sound from a sound source and having a second number of samples larger than the first number of samples based on the first signal, a transform unit that transforms the second signal into a frequency domain and generates a spectrum, a correction unit that increases a value of the spectrum in a correction band and generates a corrected spectrum, an inverse transform unit that inversely transforms the corrected spectrum into a time domain and generates a corrected signal, and a generation unit that generates a filter based on the sound pickup signal and the corrected signal.

6 Claims, 18 Drawing Sheets

(58) Field of Classification Search
CPC . H04S 7/30; H04S 7/304; H04S 7/305; H04S 7/306; H04S 7/307; H04S 1/00; H04S 3/00; G06F 3/16; G06F 3/165; G10L 15/02; G10L 15/04; G10L 15/08; G10L 15/22; G10L 2015/022; G10L 2015/025; G10L 2015/027; H10L 21/0208; H10L 21/0232; H10L 21/0272
See application file for complete search history.

(56) References Cited

U.S. PATENT DOCUMENTS

| | | | | |
|---|---|---|---|---|
| 2006/0045294 | A1 | 3/2006 | Smyth | |
| 2010/0260351 | A1* | 10/2010 | Diethorn | H04M 1/20 381/93 |
| 2014/0029758 | A1* | 1/2014 | Nakadai | G10K 11/175 381/71.1 |
| 2014/0191963 | A1* | 7/2014 | Murakoshi | G06F 3/0433 345/158 |
| 2015/0180433 | A1 | 6/2015 | Nakagawa et al. | |
| 2017/0178668 | A1* | 6/2017 | Kar | G10L 25/78 |
| 2018/0159548 | A1* | 6/2018 | Schmidt | G06G 7/19 |
| 2018/0182411 | A1* | 6/2018 | Kaskari | G10L 21/0216 |
| 2018/0343535 | A1* | 11/2018 | Murata | H04S 1/00 |
| 2019/0007784 | A1* | 1/2019 | Murata | G01H 3/12 |
| 2019/0215640 | A1* | 7/2019 | Murata | H04R 3/04 |
| 2019/0373368 | A1* | 12/2019 | Gejo | H04R 1/406 |
| 2019/0373400 | A1* | 12/2019 | Fujii | H04S 7/307 |

* cited by examiner

FILTER GENERATION DEVICE, FILTER GENERATION METHOD, AND PROGRAM

CROSS REFERENCE TO RELATED APPLICATION

This application is a Bypass Continuation of PCT Application No: PCT/JP2018/003975, filed on Feb. 6, 2018, which is based upon and claims the benefit of priority from Japanese patent application No. 2017-33204 filed on Feb. 24, 2017 and Japanese patent application No. 2017-183337 filed on Sep. 25, 2017, the disclosure of which is incorporated herein in its entirety by reference.

BACKGROUND

The present invention relates to a filter generation device, a filter generation method, and a program.

Sound localization techniques include an out-of-head localization technique, which localizes sound images outside the head of a listener by using headphones. The out-of-head localization technique localizes sound images outside the head by canceling characteristics from the headphones to the ears and giving four characteristics from stereo speakers to the ears.

In out-of-head localization reproduction, measurement signals (impulse sounds etc.) that are output from 2-channel (which is referred to hereinafter as "ch") speakers are recorded by microphones (which can be also called "mike") placed on the listener's ears. Then, a processing device generates a filter based on a sound pickup signal obtained by impulse response. The generated filter is convolved to 2-ch audio signals, thereby implementing out-of-head localization reproduction.

Patent Literature 1 (Published Japanese Translation of PCT International Publication for Patent Application, No. 2008-512015) discloses a method for acquiring a set of personalized room impulse responses. In Patent Literature 1, microphones are placed near the ears of a listener. Then, the left and right microphones record impulse sounds when driving speakers.

SUMMARY

As for the quality of sound fields reproduced by out-of-head localization, there is a problem of a low center channel volume, which causes complaints that a sound lacks mid and low frequencies, a sound localized at the center is too light, a vocal is heard too far away and the like.

This problem of a low center channel volume occurs due to speaker placement and its position relative to a listener. A frequency at which a difference between a distance from an Lch speaker to the left ear and a distance from an Rch speaker to the right ear is a half-wavelength is synthesized in a reverse phase. Thus, at a frequency where the difference in distance is a half-wavelength, sounds are heard at a low volume. Particularly, because center localization signals contain a common-mode signal in Lch and Rch, they cancel out each other at both ears. Such cancelling out occurs also due to the effect of reflection in a room.

In general, while a listener listens to speaker-reproduced sounds, the listener's head is constantly moving even through the listener thinks he/she is staying still, which is difficult to recognize. However, in the case of out-of-head localization, because a spatial transfer function at a certain fixed position is used, a sound synthesized in a reverse phase is presented at a frequency determined by a distance from speakers.

Further, a head-related transfer function (HRTF) is used as the spatial acoustic transfer characteristics from speakers to the ears. The head-related transfer function is acquired by measurement on a dummy head or a user. A large number of analyses and studies on HRTF, a sense of listening and localization have been conducted.

The spatial acoustic transfer characteristics are classified into two types: direct sound from a sound source to a listening position and reflected sound (and diffracted sound) that arrives after being reflected on an object such as a wall surface or a bottom surface. The direct sound, the reflected sound and their relationship are components representing the entire spatial acoustic transfer characteristics. In some simulation of acoustic characteristics, the direct sound and the reflected sound are simulated separately and then integrated together to calculate the entire characteristics. In the above analyses and studies also, it is significantly effective to separately handle the transfer characteristics of two types of sounds.

It is thus desirable to appropriately separate the direct sound and the reflected sound from sound pickup signals picked up by microphones.

A filter generation device according to this embodiment includes a microphone configured to pick up a measurement signal output from a sound source and acquire a sound pickup signal, and a processing unit configured to generate a filter in accordance with transfer characteristics from the sound source to the microphone based on the sound pickup signal, wherein the processing unit includes an extraction unit configured to extract a first signal having a first number of samples from samples preceding a boundary sample of the sound pickup signal, a signal generation unit configured to generate a second signal containing a direct sound from the sound source and having a second number of samples larger than the first number of samples based on the first signal, a transform unit configured to transform the second signal into a frequency domain and thereby generate a spectrum, a correction unit configured to increase a value of the spectrum in a band equal to or lower than a specified frequency and thereby generate a corrected spectrum, an inverse transform unit configured to inversely transform the corrected spectrum into a time domain and thereby generate a corrected signal, and a generation unit configured to generate a filter by using the sound pickup signal and the corrected signal, the generation unit generating a filter value preceding the boundary sample by a value of the corrected signal and generating a filter value subsequent to the boundary sample and having less than the second number of samples by a sum of the sound pickup signal and the corrected signal.

A filter generation method according to this embodiment is a filter generation method of generating a filter in accordance with transfer characteristics by picking up a measurement signal output from a sound source with use of a microphone, the method including a step of acquiring a sound pickup signal by using a microphone, a step of extracting a first signal having a first number of samples from samples preceding a boundary sample of the sound pickup signal, a step of generating a second signal containing a direct sound from the sound source and having a second number of samples larger than the first number of samples based on the first signal, a step of transforming the second signal into a frequency domain and thereby generating a spectrum, a step of increasing a value of the spectrum in a band equal to or lower than a specified frequency and thereby generating a corrected spectrum, a step of inversely transforming the corrected spectrum into a time domain and thereby generating a corrected signal, and a step of generating a filter by using the sound pickup signal and the corrected signal, the step generating a filter value preceding the boundary sample by a value of the corrected signal and generating a filter value subsequent to the boundary sample and having less than the second number of samples by a sum of the sound pickup signal and the corrected signal.

A program according to this embodiment causes a computer to execute a filter generation method of generating a filter in accordance with transfer characteristics by picking up a measurement signal output from a sound source with use of a microphone, the filter generation method including a step of acquiring a sound pickup signal by using a microphone, a step of extracting a first signal having a first number of samples from samples preceding a boundary sample of the sound pickup signal, a step of generating a second signal containing a direct sound from the sound source and having a second number of samples larger than the first number of samples based on the first signal, a step of transforming the second signal into a frequency domain and thereby generating a spectrum, a step of increasing a value of the spectrum in a band equal to or lower than a specified frequency and thereby generating a corrected spectrum, a step of inversely transforming the corrected spectrum into a time domain and thereby generating a corrected signal, and a step of generating a filter by using the sound pickup signal and the corrected signal, the step generating a filter value preceding the boundary sample by a value of the corrected signal and generating a filter value subsequent to the boundary sample and having less than the second number of samples by a sum of the sound pickup signal and the corrected signal.

DETAILED DESCRIPTION

In this embodiment, a filter generation device measures transfer characteristics from speakers to microphones. The filter generation device then generates a filter based on the measured transfer characteristics.

The overview of a sound localization process using a filter generated by a filter generation device according to this embodiment is described hereinafter. Out-of-head localization, which is an example of a sound localization device, is described in the following example. The out-of-head localization process according to this embodiment performs out-of-head localization by using personal spatial acoustic transfer characteristics (which is also called a spatial acoustic transfer function) and ear canal transfer characteristics (which is also called an ear canal transfer function). The spatial acoustic transfer characteristics are transfer characteristics from a sound source such as speakers to the ear canal. The ear canal transfer characteristics are transfer characteristics from the entrance of the ear canal to the eardrum. In this embodiment, out-of-head localization is achieved by using the spatial acoustic transfer characteristics from speakers to a listener's ears and inverse characteristics of the ear canal transfer characteristics when headphones are worn.

An out-of-head localization device according to this embodiment is an information processing device such as a personal computer, a smart phone, a tablet PC or the like, and it includes a processing means such as a processor, a storage means such as a memory or a hard disk, a display means such as a liquid crystal monitor, an input means such as a touch panel, a button, a keyboard and a mouse, and an output means with headphones or earphones. To be specific, out-of-head localization according to this embodiment is performed by a user terminal such as a personal computer, a smart phone, or a tablet PC. The user terminal is an information processor including a processing means such as a processor, a storage means such as a memory or a hard disk, a display means such as a liquid crystal monitor, and an input means such as a touch panel, a button, a keyboard and a mouse. The user terminal may have a communication function to transmit and receive data. Further, an output means (output unit) with headphones or earphones is connected to the user terminal.

First Embodiment (Out-Of-Head Localization Device)

Figure 1:
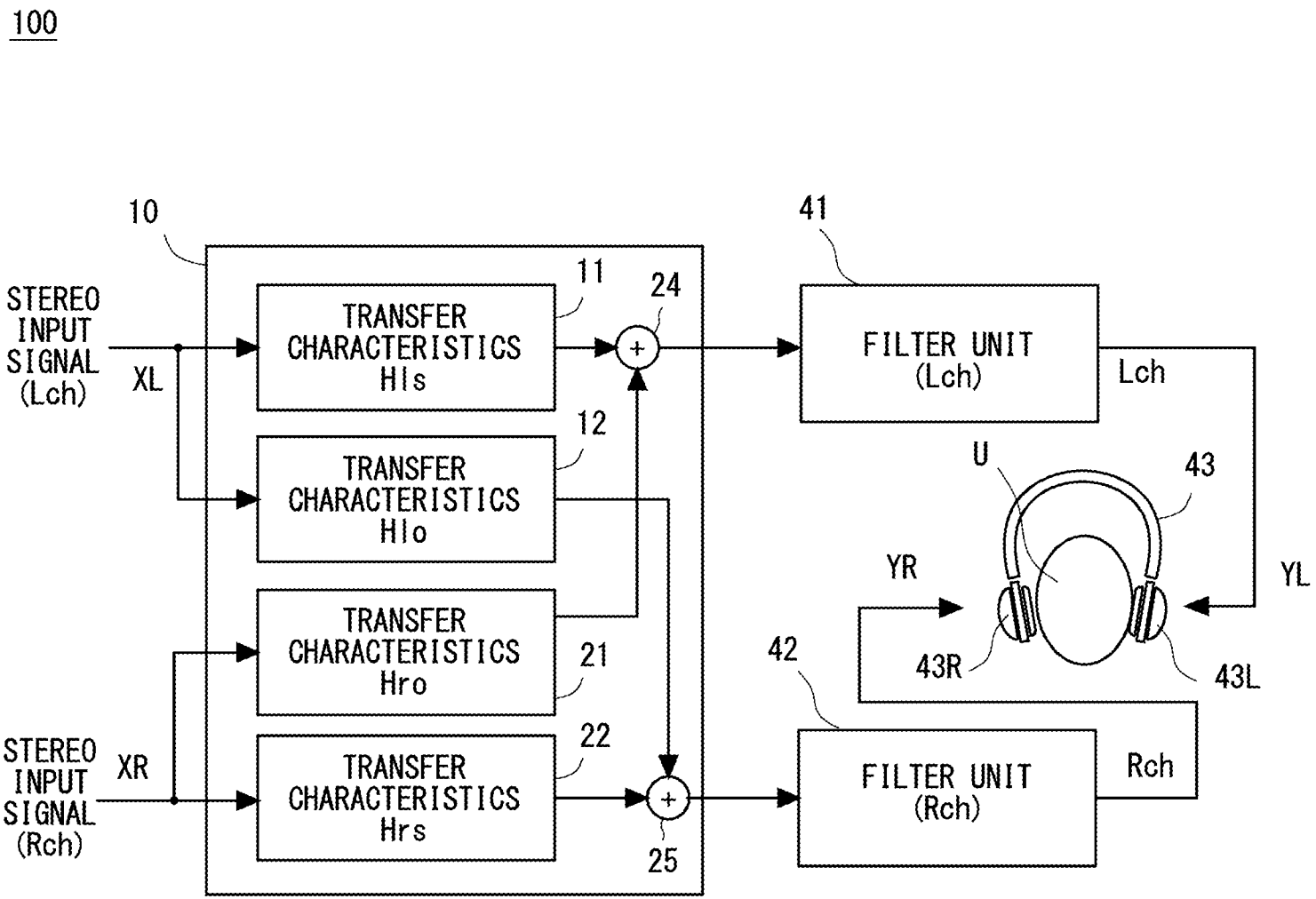
FIG. 1 is a block diagram showing an out-of-head localization device according to an embodiment.

FIG. 1 shows an out-of-head localization device 100, which is an example of a sound field reproduction device according to this embodiment. FIG. 1 is a block diagram of the out-of-head localization device. The out-of-head localization device 100 reproduces sound fields for a user U who is wearing headphones 43. Thus, the out-of-head localization device 100 performs sound localization for L-ch and R-ch stereo input signals XL and XR. The L-ch and R-ch stereo input signals XL and XR are analog audio reproduced signals that are output from a CD (Compact Disc) player or the like or digital audio data such as mp3 (MPEG Audio Layer-3). Note that the out-of-head localization device 100 is not limited to a physically single device, and a part of processing may be performed in a different device. For example, a part of processing may be performed by a personal computer or the like, and the rest of processing may be performed by a DSP (Digital Signal Processor) included in the headphones 43 or the like.

The out-of-head localization device 100 includes an out-of-head localization unit 10, a filter unit 41, a filter unit 42, and headphones 43. The out-of-head localization unit 10, the filter unit 41 and the filter unit 42 can be implemented by a processor or the like, to be specific.

The out-of-head localization unit 10 includes convolution calculation units 11 to 12 and 21 to 22, and adders 24 and 25. The convolution calculation units 11 to 12 and 21 to 22 perform convolution processing using the spatial acoustic transfer characteristics. The stereo input signals XL and XR from a CD player or the like are input to the out-of-head localization unit 10. The spatial acoustic transfer characteristics are set to the out-of-head localization unit 10. The out-of-head localization unit 10 convolves the spatial acoustic transfer characteristics into each of the stereo input signals XL and XR having the respective channels. The spatial acoustic transfer characteristics may be a head-related transfer function HRTF measured in the head or auricle of a measured person (user U), or may be the head-related transfer function of a dummy head or a third person. Those transfer characteristics may be measured on sight, or may be prepared in advance.

The spatial acoustic transfer characteristics are a set of four spatial acoustic transfer characteristics Hls, Hlo, Hro and Hrs. Data used for convolution in the convolution calculation units 11 to 12 and 21 to 22 is a spatial acoustic filter. The spatial acoustic filter is generated by cutting out the spatial acoustic transfer characteristics Hls, Hlo, Hro and Hrs with a specified filter length.

Each of the spatial acoustic transfer characteristics Hls, Hlo, Hro and Hrs is acquired in advance by impulse response measurement or the like. For example, the user U wears microphones on the left and right ears, respectively. Left and right speakers placed in front of the user U output impulse sounds for performing impulse response measurement. Then, the microphones pick up measurement signals such as the impulse sounds output from the speakers. The spatial acoustic transfer characteristics Hls, Hlo, Hro and Hrs are acquired based on sound pickup signals in the microphones. The spatial acoustic transfer characteristics Hls between the left speaker and the left microphone, the spatial acoustic transfer characteristics Hlo between the left speaker and the right microphone, the spatial acoustic transfer characteristics Hro between the right speaker and the left microphone, and the spatial acoustic transfer characteristics Hrs between the right speaker and the right microphone are measured.

The convolution calculation unit 11 convolves the spatial acoustic filter in accordance with the spatial acoustic transfer characteristics Hls to the L-ch stereo input signal XL. The convolution calculation unit 11 outputs convolution calculation data to the adder 24. The convolution calculation unit 21 convolves the spatial acoustic filter in accordance with the spatial acoustic transfer characteristics Hro to the R-ch stereo input signal XR. The convolution calculation unit 21 outputs convolution calculation data to the adder 24. The adder 24 adds the two convolution calculation data and outputs the data to the filter unit 41.

The convolution calculation unit 12 convolves the spatial acoustic filter in accordance with the spatial acoustic transfer characteristics Hlo to the L-ch stereo input signal XL. The convolution calculation unit 12 outputs convolution calculation data to the adder 25. The convolution calculation unit 22 convolves the spatial acoustic filter in accordance with the spatial acoustic transfer characteristics Hrs to the R-ch stereo input signal XR. The convolution calculation unit 22 outputs convolution calculation data to the adder 25. The adder 25 adds the two convolution calculation data and outputs the data to the filter unit 42.

An inverse filter that cancels out the headphone characteristics (characteristics between a reproduction unit of headphones and a microphone) is set to the filter units 41 and 42. Then, the inverse filter is convolved to the reproduced signals (convolution calculation signals) on which processing in the out-of-head localization unit 10 has been performed. The filter unit 41 convolves the inverse filter to the L-ch signal from the adder 24. Likewise, the filter unit 42 convolves the inverse filter to the R-ch signal from the adder 25. The inverse filter cancels out the characteristics from the headphone unit to the microphone when the headphones 43 are worn. The microphone may be placed at any position between the entrance of the ear canal and the eardrum. The inverse filter is calculated from a result of measuring the characteristics of the user U as described later. Alternatively, the inverse filter calculated from the headphone characteristics measured using an arbitrary outer ear such as a dummy head or the like may be prepared in advance.

The filter unit 41 outputs the processed L-ch signal to a left unit 43L of the headphones 43. The filter unit 42 outputs the processed R-ch signal to a right unit 43R of the headphones 43. The user U is wearing the headphones 43. The headphones 43 output the L-ch signal and the R-ch signal toward the user U. It is thereby possible to reproduce sound images localized outside the head of the user U.

As described above, the out-of-head localization device 100 performs out-of-head localization by using the spatial acoustic filters in accordance with the spatial acoustic transfer characteristics Hls, Hlo, Hro and Hrs and the inverse filters of the headphone characteristics. In the following description, the spatial acoustic filters in accordance with the spatial acoustic transfer characteristics Hls, Hlo, Hro and Hrs and the inverse filter of the headphone characteristics are referred to collectively as an out-of-head localization filter. In the case of 2*ch* stereo reproduced signals, the out-of-head localization filter is composed of four spatial acoustic filters and two inverse filters. The out-of-head localization device 100 then carries out convolution calculation on the stereo reproduced signals by using the total six out-of-head localization filters and thereby performs out-of-head localization.

(Filter Generation Device)

Figure 2:
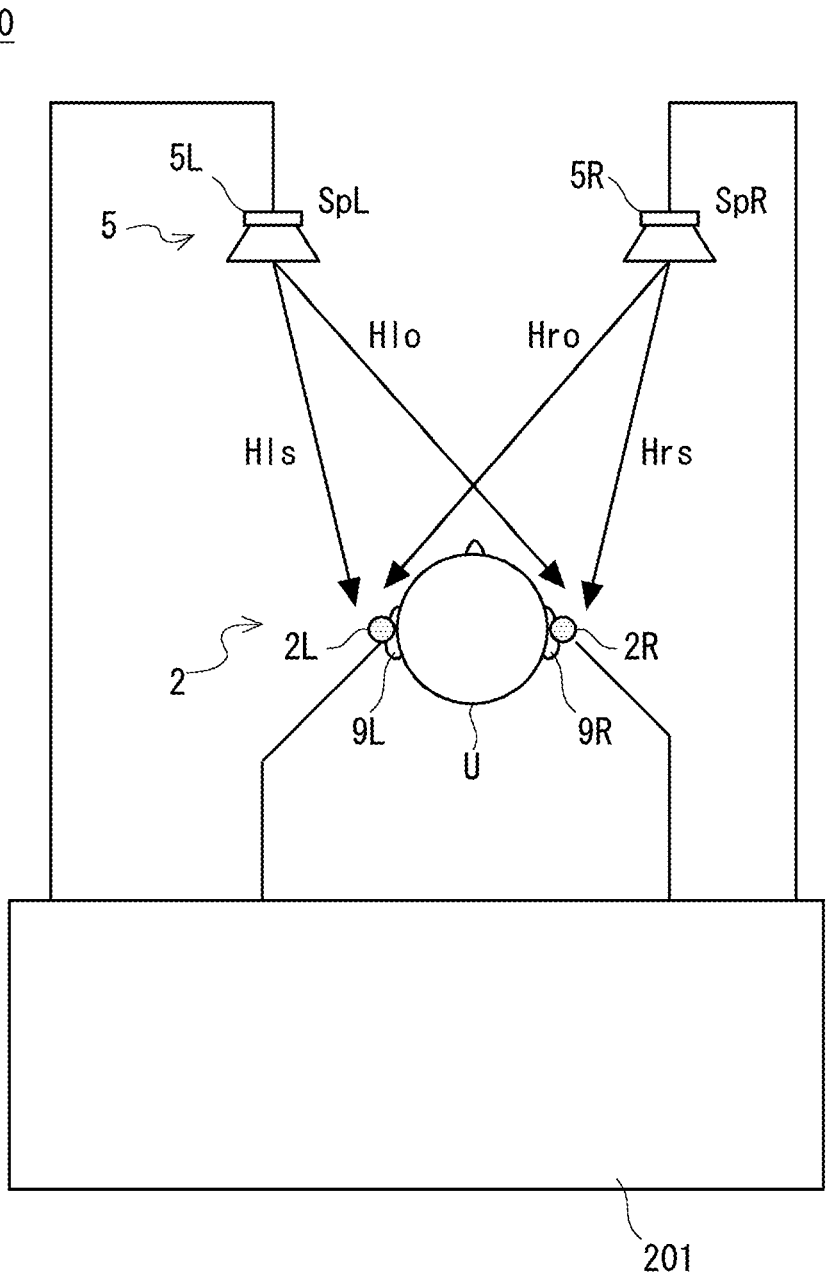
FIG. 2 is a view showing the structure of a filter generation device that generates a filter.

A filter generation device that measures spatial acoustic transfer characteristics (which are referred to hereinafter as transfer characteristics) and generates filters is described hereinafter with reference to FIG. 2. FIG. 2 is a view schematically showing the measurement structure of a filter generation device 200. Note that the filter generation device 200 may be a common device to the out-of-head localization device 100 shown in FIG. 1. Alternatively, a part or the whole of the filter generation device 200 may be a different device from the out-of-head localization device 100.

As shown in FIG. 2, the filter generation device 200 includes stereo speakers 5, stereo microphones 2, and a signal processor 201. The stereo speakers 5 are placed in a measurement environment. The measurement environment may be the user U's room at home, a dealer or showroom of an audio system or the like. In the measurement environment, sounds are reflected on a floor surface or a wall surface.

In this embodiment, the signal processor 201 of the filter generation device 200 performs processing for appropriately generating filters in accordance with the transfer characteristics. The processor may be a personal computer (PC), a tablet terminal, a smart phone or the like.

The signal processor 201 generates a measurement signal and outputs it to the stereo speakers 5. Note that the signal processor 201 generates an impulse signal, a TSP (Time Stretched Pulse) signal or the like as the measurement signal for measuring the transfer characteristics. The measurement signal contains a measurement sound such as an impulse sound. Further, the signal processor 201 acquires a sound pickup signal picked up by the stereo microphones 2. The signal processor 201 includes a memory or the like that stores measurement data of the transfer characteristics.

The stereo speakers 5 include a left speaker 5L and a right speaker 5R. For example, the left speaker 5L and the right speaker 5R are placed in front of a user U. The left speaker 5L and the right speaker 5R output impulse sounds for impulse response measurement and the like. Although the number of speakers, which serve as sound sources, is 2 (stereo speakers) in this embodiment, the number of sound sources to be used for measurement is not limited to 2, and it may be 1 or more. Therefore, this embodiment is applicable also to 1ch mono or 5.1ch, 7.1ch etc. multichannel environment.

The stereo microphones 2 include a left microphone 2L and a right microphone 2R. The left microphone 2L is placed on a left ear 9L of the user U, and the right microphone 2R is placed on a right ear 9R of the user U. To be specific, the microphones 2L and 2R are preferably placed at a position between the entrance of the ear canal and the eardrum of the left ear 9L and the right ear 9R, respectively. The microphones 2L and 2R pick up measurement signals output from the stereo speakers 5 and output sound pickup signals to the signal processor 201. The user U may be a person or a dummy head. In other words, in this embodiment, the user U is a concept that includes not only a person but also a dummy head.

As described above, impulse sounds output from the left and right speakers 5L and 5R are picked up by the microphones 2L and 2R, respectively, and impulse response is obtained based on the sound pickup signals. The filter generation device 200 stores the sound pickup signals acquired based on the impulse response measurement into a memory or the like. The transfer characteristics Hls between the left speaker 5L and the left microphone 2L, the transfer characteristics Hlo between the left speaker 5L and the right microphone 2R, the transfer characteristics Hro between the right speaker 5R and the left microphone 2L, and the transfer characteristics Hrs between the right speaker 5R and the right microphone 2R are thereby measured. Specifically, the left microphone 2L picks up the measurement signal that is output from the left speaker 5L, and thereby the transfer characteristics Hls are acquired. The right microphone 2R picks up the measurement signal that is output from the left speaker 5L, and thereby the transfer characteristics Hlo are acquired. The left microphone 2L picks up the measurement signal that is output from the right speaker 5R, and thereby the transfer characteristics Hro are acquired. The right microphone 2R picks up the measurement signal that is output from the right speaker 5R, and thereby the transfer characteristics Hrs are acquired.

Then, the filter generation device 200 generates filters in accordance with the transfer characteristics Hls, Hlo, Hro and Hrs from the left and right speakers 5L and 5R to the left and right microphones 2L and 2R based on the sound pickup signals. For example, the filter generation device 200 may correct the transfer characteristics Hls, Hlo, Hro and Hrs as described later. Then, the filter generation device 200 cuts out the corrected transfer characteristics Hls, Hlo, Hro and Hrs with a specified filter length and performs arithmetic processing. In this manner, the filter generation device 200 generates filters to be used for convolution calculation of the out-of-head localization device 100. As shown in FIG. 1, the out-of-head localization device 100 performs out-of-head localization by using the filters in accordance with the transfer characteristics Hls, Hlo, Hro and Hrs between the left and right speakers 5L and 5R and the left and right microphones 2L and 2R. Specifically, the out-of-head localization is performed by convolving the filters in accordance with the transfer characteristics to the audio reproduced signals.

Further, in the measurement environment, when measurement signals are output from the speakers 5L and 5R, sound pickup signals contain direct sound and reflected sound. The direct sound is a sound that directly reaches the microphone 2L or 2R (the ear 9L or 9R) from the speaker 5L or 5R. Specifically, the direct sound is a sound that reaches the microphone 2L or 2R from the speaker 5L or 5R without being reflected on a floor surface, a wall surface or the like. On the other hand, the reflected sound is a sound that is reflected on a floor surface, a wall surface or the like after being output from the speaker 5L or 5R, and then reaches the microphone 2L or 2R. The direct sound reaches the ear earlier than the reflected sound. Thus, the sound pickup signal corresponding to each of the transfer characteristics Hls, Hlo, Hro and Hrs contains the direct sound and the reflected sound. Then, the reflected sound reflected on an object such as a wall surface or a floor surface arrives after the direct sound.

Figure 3:
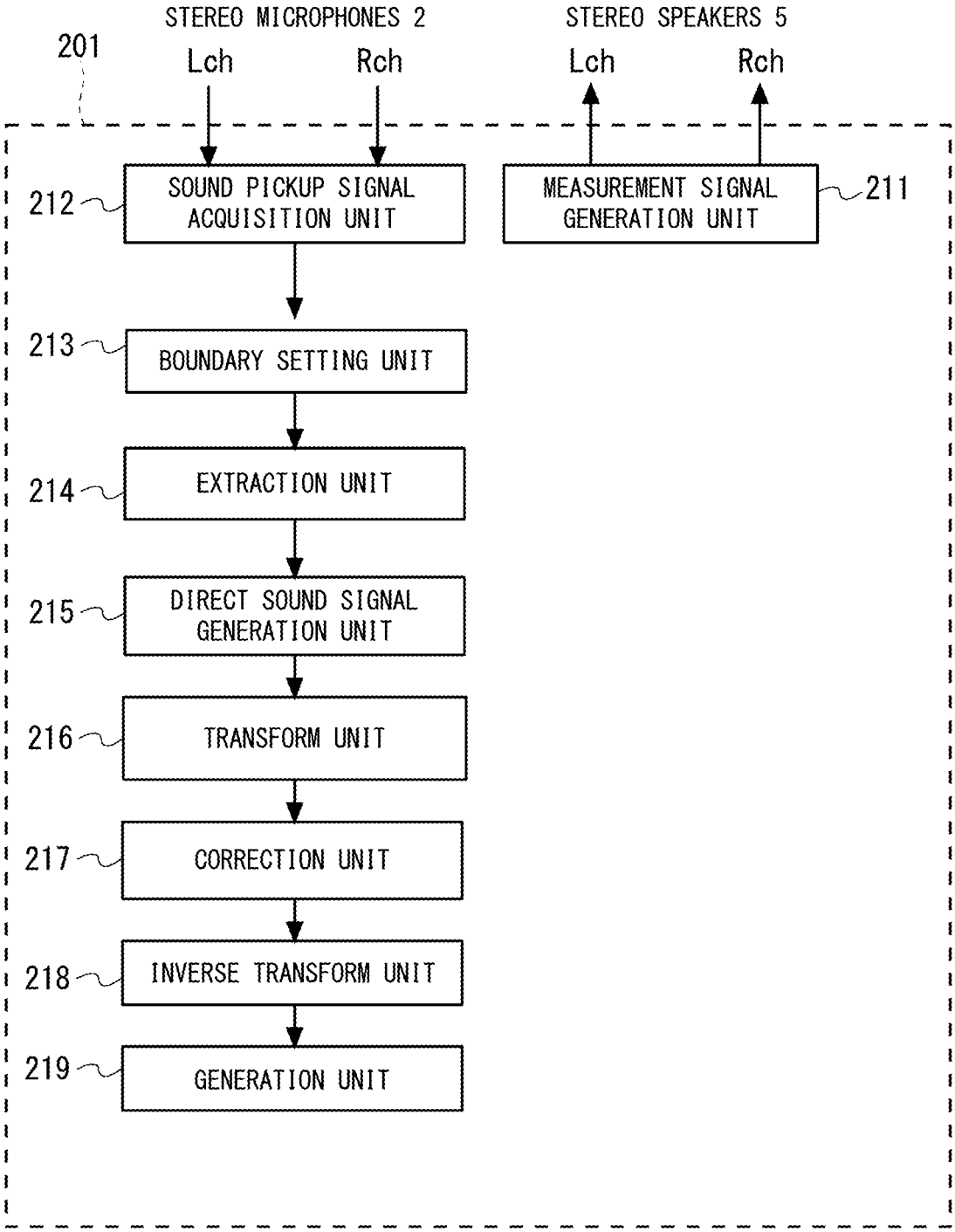
FIG. 3 is a control block diagram showing the structure of a signal processor of the filter generation device.
Figure 4:
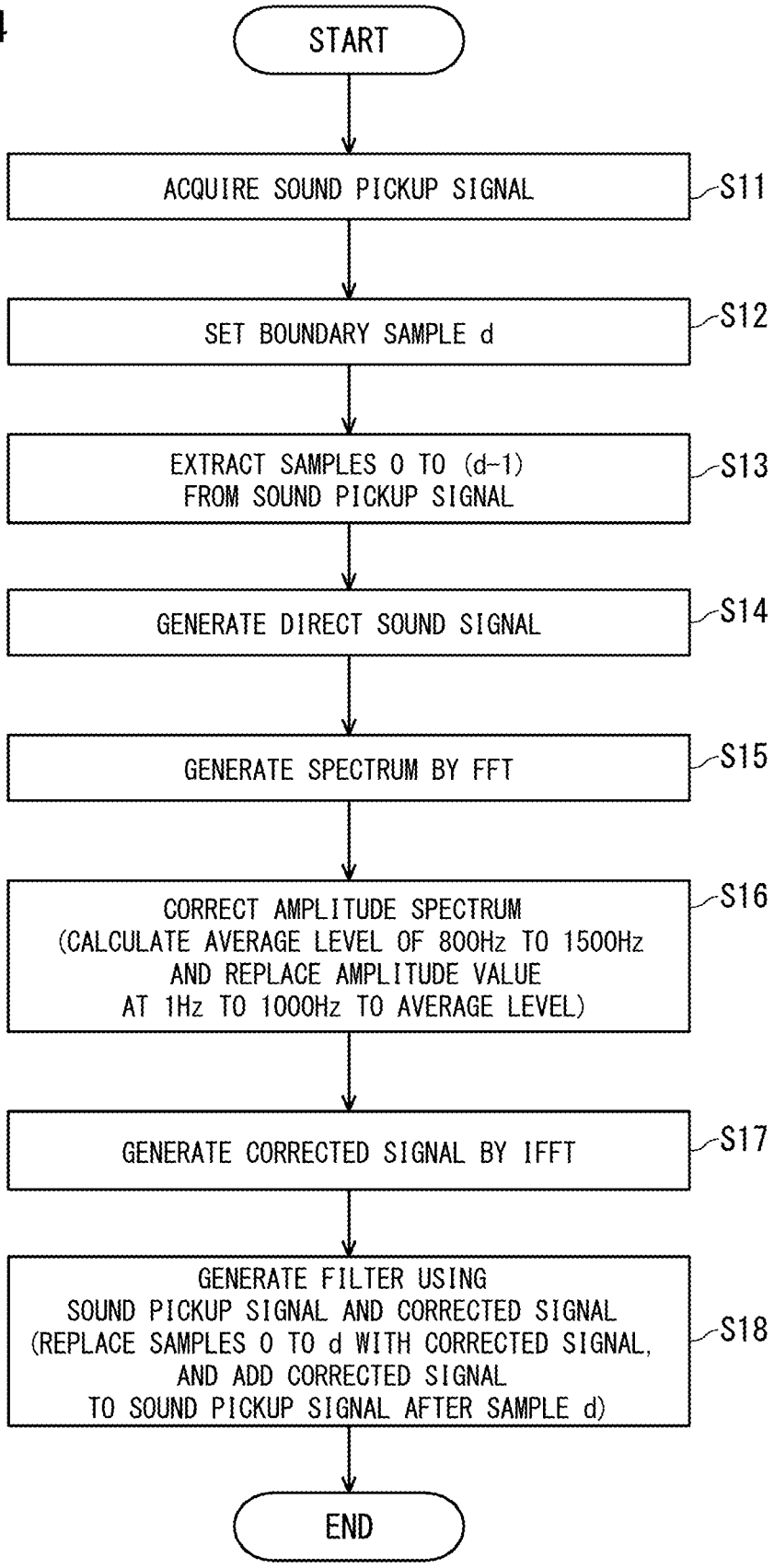
FIG. 4 is a flowchart showing a filter generation method.

The signal processor 201 of the filter generation device 200 and its processing are described in detail hereinbelow. FIG. 3 is a control block diagram showing the signal processor 201 of the filter generation device 200. FIG. 4 is a flowchart showing a process in the signal processor 201. Note that the filter generation device 200 performs the same processing on the sound pickup signal corresponding to each of the transfer characteristics Hls, Hlo, Hro and Hrs. Specifically, the process shown in FIG. 4 is performed on each of the four sound pickup signals corresponding to the transfer characteristics Hls, Hlo, Hro and Hrs. Filters corresponding to the transfer characteristics Hls, Hlo, Hro and Hrs are thereby generated.

The signal processor 201 includes a measurement signal generation unit 211, a sound pickup signal acquisition unit 212, a boundary setting unit 213, an extraction unit 214, a direct sound signal generation unit 215, a transform unit 216, a correction unit 217, an inverse transform unit 218, and a generation unit 219. Note that, in FIG. 3, an A/D converter, a D/A converter and the like are omitted.

The measurement signal generation unit 211 includes a D/A converter, an amplifier and the like, and it generates a measurement signal. The measurement signal generation unit 211 outputs the generated measurement signal to each of the stereo speakers 5. Each of the left speaker 5L and the right speaker 5R outputs a measurement signal for measuring the transfer characteristics. Impulse response measurement by the left speaker 5L and impulse response measurement by the right speaker 5R are carried out, respectively. The measurement signal may be an impulse signal, a TSP (Time Stretched Pulse) signal or the like. The measurement signal contains a measurement sound such as an impulse sound.

Each of the left microphone 2L and the right microphone 2R of the stereo microphones 2 picks up the measurement signal, and outputs a sound pickup signal to the signal processor 201. The sound pickup signal acquisition unit 212 acquires the sound pickup signals from the left microphone 2L and the right microphone 2R (S11). Note that the sound pickup signal acquisition unit 212 includes an A/D converter, an amplifier and the like, and it may perform A/D conversion, amplification and the like of the sound pickup signals from the left microphone 2L and the right microphone 2R. Further, the sound pickup signal acquisition unit 212 may perform synchronous addition of the signals obtained by a plurality of times of measurement.

Figure 5:
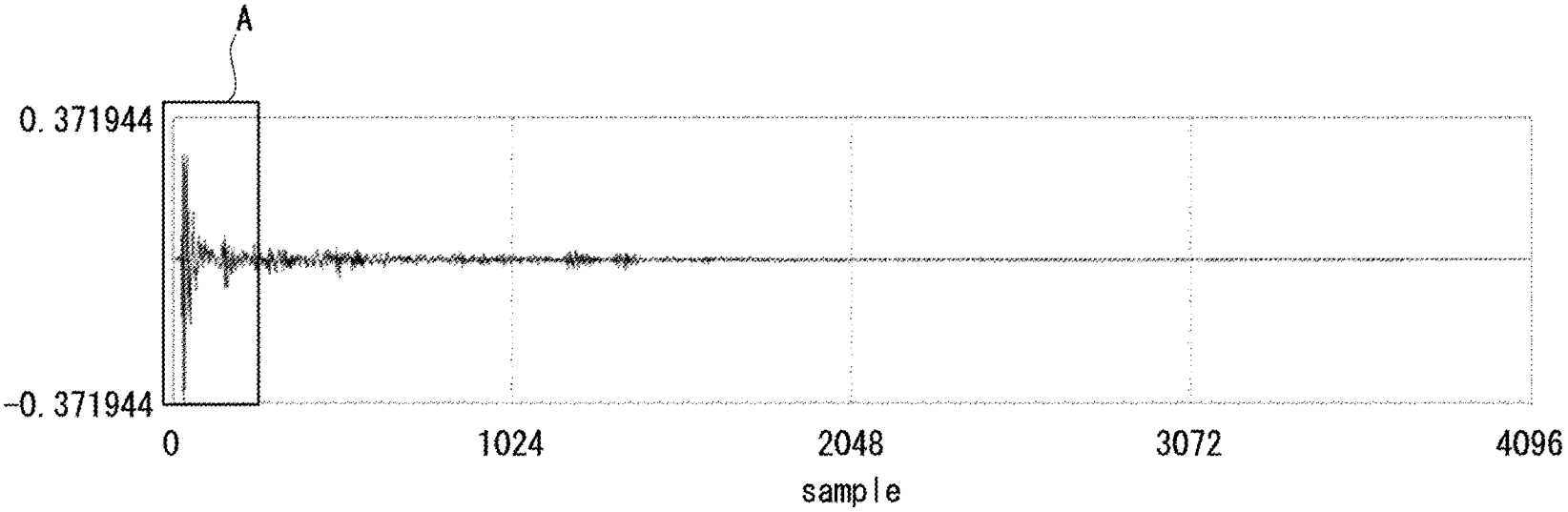
FIG. 5 is a waveform chart showing a sound pickup signal picked up by microphones.

FIG. 5 shows a waveform chart of a sound pickup signal. The horizontal axis of FIG. 5 indicates a sample number, and the vertical axis indicates the amplitude (e.g., output voltage) of the microphone. The sample number is an integer corresponding to a time, and a sample with a sample number of 0 is data (sample) sampled at the earliest timing. The sound pickup signal in FIG. 5 is acquired at a sampling frequency of FS=48 kHz. The number of samples of the sound pickup signal in FIG. 5 is 4096 samples. The sound pickup signal contains the direct sound and the reflected sound of impulse sounds.

The boundary setting unit 213 sets a boundary sample d of the sound pickup signal (S12). The boundary sample d is a sample at the boundary between the direct sound and the reflected sound from the speaker 5L or 5R. Note that the boundary sample d is a number of a sample corresponding to the boundary between the direct sound and the reflected sound, and d is an integer from 0 to 4096. As described above, the direct sound is a sound that reaches the user U's ear directly from the speaker 5L or 5R, and the reflected sound is a sound that reaches the user U's ear 2L or 2R from the speaker 5L or 5R after being reflected on a floor surface, a wall surface or the like. Thus, the boundary sample d corresponds to a sample at the boundary between the direct sound and the reflected sound.

Figure 6:
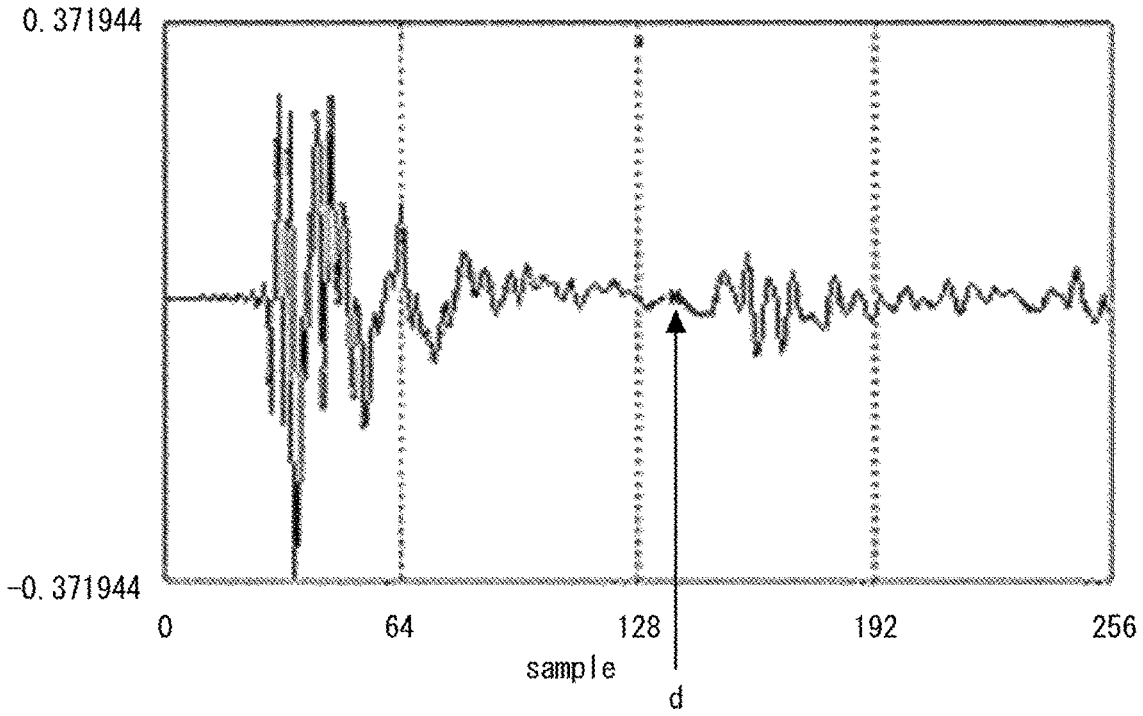
FIG. 6 is an enlarged view of a sound pickup signal for indicating a boundary sample d.

FIG. 6 shows the acquired sound pickup signal and the boundary sample d. FIG. 6 is a waveform chart showing a part (in a square A) of FIG. 5 in an enlarged scale. For example, the boundary sample d=140 in FIG. 6.

Setting of the boundary sample d may be made by the user U. For example, a waveform of a sound pickup signal is displayed on a display of a personal computer, and the user U designates the position of the boundary sample d on the display. Note that setting of the boundary sample d may be made by a person other than the user U. Alternatively, the signal processor 201 may automatically set the boundary sample d. When setting the boundary sample d automatically, the boundary sample d can be calculated from the waveform of the sound pickup signal. To be specific, the boundary setting unit 213 calculates an envelope of the sound pickup signal by Hilbert transform. Then, the boundary setting unit 213 sets a position (close to zero-cross) immediately before a loud sound following the direct sound in the envelope as the boundary sample. The sound pickup signal preceding the boundary sample d contains the direct sound that reaches the microphone 2 directly from the sound source. The sound pickup signal subsequent to the boundary sample d contains the reflected sound that is reflected and reaches the microphone 2 after being output from the sound source.

The extraction unit 214 extracts the samples of 0 to (d−1) from the sound pickup signal (S13). To be specific, the extraction unit 214 extracts the samples earlier than the boundary sample of the sound pickup signal. For example, it extracts d number of samples from 0 to (d−1) of the sound pickup signal. Because the sample number of the boundary sample is d=140 in this example, the extraction unit 214 extracts 140 samples from 0 to 139. The extraction unit 214 may extract samples beginning with a sample with a sample number different from 0. In other words, the sample number s of the first sample to be extracted is not limited to 0, and it may be an integer larger than 0. The extraction unit 214 may extract samples with sample numbers s to d. Note that the sample number s is an integer equal to or more than 0 and less than d. The number of samples extracted by the extraction unit 214 is referred to hereinafter as a first number of samples. Further, a signal having the first number of samples extracted by the extraction unit 214 is referred to as a first signal.

Figure 7:
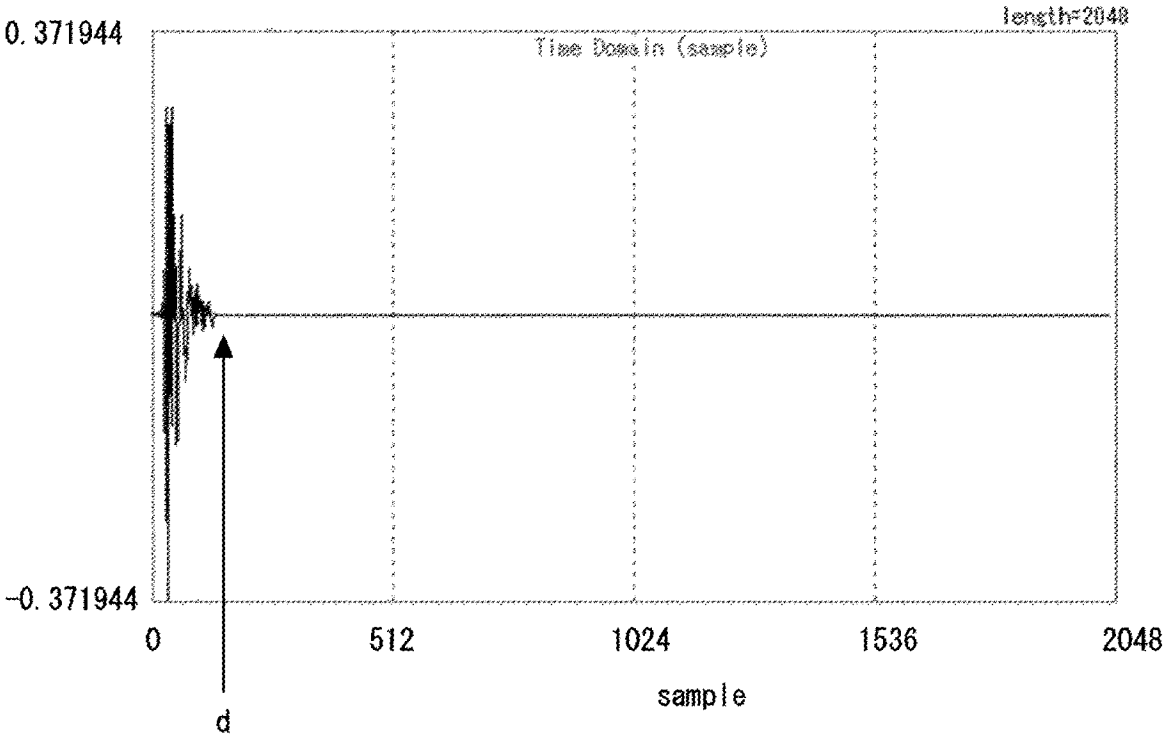
FIG. 7 is a waveform chart showing a direct sound signal generated based on a sample extracted from a sound pickup signal.

The direct sound signal generation unit 215 generates a direct sound signal based on the first signal extracted by the extraction unit 214 (S14). The direct sound signal contains the direct sound and includes the number of samples greater than d. The number of samples of the direct sound signal is referred to hereinafter as a second number of samples, and the second number of samples is 2048 to be specific. Thus, the second number of samples is half the number of samples of the sound pickup signal. For the samples 0 to d, the extracted samples are used without any change. The samples subsequent to the boundary sample d are fixed values. For example, the samples d to 2047 are all 0. Accordingly, the second number of samples is larger than the first number of samples. FIG. 7 shows the waveform of the direct sound signal. In FIG. 7, the values of samples subsequent to the boundary sample d are fixed at 0. Note that the direct sound signal is referred to also as a second signal.

Although the second number of samples is 2048 in this example, the second number of samples is not limited to 2048. In the case of the sampling frequency FS=48 kHz, the second number of samples is preferably 256 or larger, and more preferably 2048 or larger to ensure a sufficiently high accuracy in low frequencies. Further, it is preferable to set the second number of samples in such a way that the direct sound signal has a data length of 5 msec or longer, and more preferably 20 msec or longer.

The transform unit 216 generates spectrums from the direct sound signal by FFT (fast Fourier transform) (S15). An amplitude spectrum and a phase spectrum of the direct sound signal are thereby generated. Note that a power spectrum may be generated instead of the amplitude spectrum. In the case of using the power spectrum, the correction unit 217 corrects the power spectrum in the following step. Note that the transform unit 216 may transform the direct sound signal into frequency domain data by discrete Fourier transform or discrete cosine transform.

Then, the correction unit 217 corrects the amplitude spectrum (S16). To be specific, the correction unit 217 corrects the amplitude spectrum so as to increase the amplitude value in a correction band. The corrected amplitude spectrum is referred to also as a corrected spectrum. In this embodiment, the phase spectrum is not corrected, and only the amplitude spectrum is corrected. Thus, the correction unit 217 uses the phase spectrum without any correction.

The correction band is a band with a specified frequency (correction upper limit frequency) or lower. For example, the correction band is a band from the lowest frequency (1 Hz) to 1000 Hz. The correction band, however, is not limited to this band. A different value may be set as the correction upper limit frequency.

The correction unit 217 sets the amplitude value of spectrums in the correction band to a corrected level. In this example, the corrected level is the average level of the amplitude value of 800 Hz to 1500 Hz. Specifically, the correction unit 217 calculates the average level of the amplitude value of 800 Hz to 1500 Hz as the corrected level. Then, the correction unit 217 replaces the amplitude value of the amplitude spectrum in the correction band with the corrected level. Thus, in the corrected amplitude spectrum, the amplitude value in the correction band is a constant value.

Figure 8:
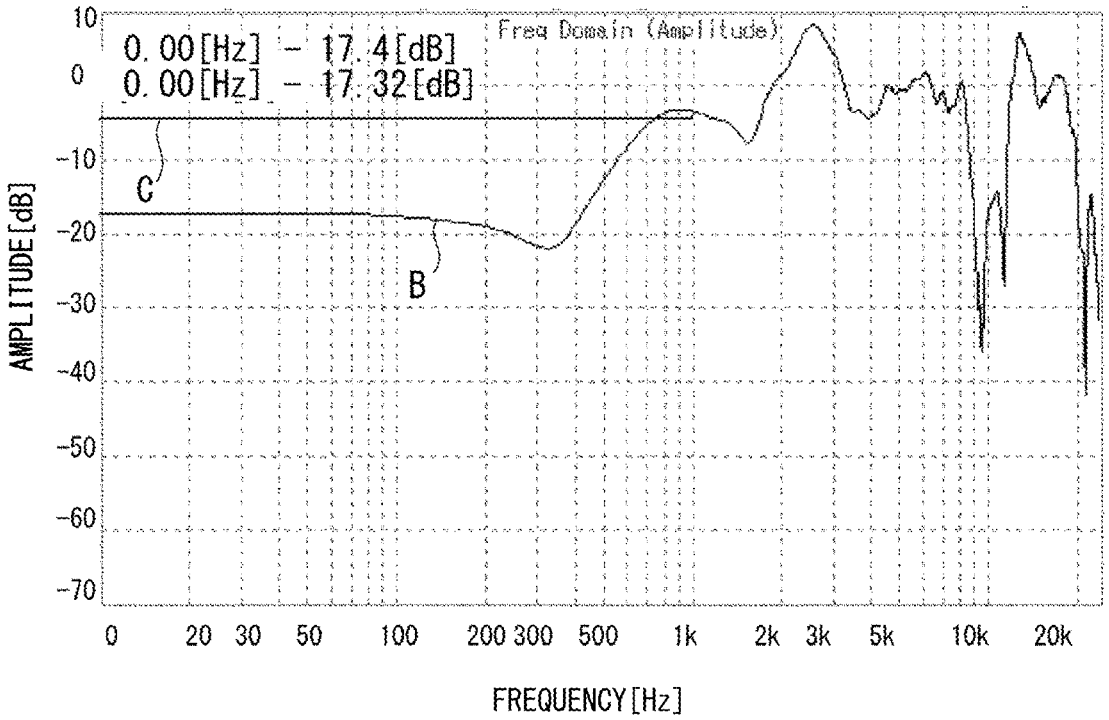
FIG. 8 is a view showing an amplitude spectrum of a direct sound signal and an amplitude spectrum after correction.

FIG. 8 shows an amplitude spectrum B before correction and an amplitude spectrum C after the correction. In FIG. 8, the horizontal axis indicates a frequency [Hz] and the vertical axis indicates an amplitude [dB], which is in logarithmic expression. In the amplitude spectrum after correction, the amplitude [dB] in the correction band of 1000 Hz or less is constant. The correction unit 217 does not correct the phase spectrum.

A band for calculating the corrected level is a band for calculation. The band for calculation is a band defined by a first frequency to a second frequency lower than the first frequency. The band for calculation is a band from the second frequency to the first frequency. In the above example, the second frequency in the band for calculation is 1500 Hz, and the first frequency in the band for calculation is 800 Hz. The band for calculation is not limited to 800 Hz to 1500 Hz as a matter of course. The first frequency and the second frequency that define the band for calculation may be arbitrary frequencies, not limited to 1500 Hz and 800 Hz.

It is preferred that the first frequency that defines the band for calculation is higher than the upper limit frequency that defines the correction band. The first and second frequencies may be determined by examining the frequency characteristics of the transfer characteristics Hls, Hlo, Hro and Hrs in advance. A value other than the average level of the amplitude may be used as a matter of course. When calculating the first and second frequencies, the frequency characteristics may be displayed, and preferred frequencies may be specified to correct dips in mid and low frequencies.

The correction unit 217 calculates the corrected level based on the amplitude value of the band for calculation. Further, although the corrected level in the correction band is set to the average of the amplitude value in the band for calculation in the above example, the corrected level is not limited to the average of the amplitude value. For example, the corrected level may be a weighted average of the amplitude value. Further, the corrected level is not constant in the entire correction band. The corrected level may vary according to the frequency in the correction band.

As another correction method, the correction unit 217 may set the amplitude level of frequencies lower than a specified frequency to a fixed level in such a way that the average amplitude level in frequencies equal to or higher than the specified frequency and the average amplitude level in frequencies lower than the specified frequency are the same. Further, the amplitude level may be shifted in parallel along the amplitude axis while maintaining the overall shape of the frequency characteristics. The specified frequency may be the correction upper limit frequency.

Further, as another method, the correction unit 217 may store frequency characteristics data of the speaker 5L and the speaker 5R in advance, and replace amplitude levels equal to or lower than a specified frequency with the frequency characteristics data of the speaker 5L and the speaker 5R. Further, the correction unit 217 may store the frequency characteristics data in low frequencies of the head-related transfer function obtained by simulation on a rigid sphere with a width corresponding to a distance (e.g., about 18 cm) between the left and right human ears, and make replacement in the same manner. The specified frequency may be the correction upper limit frequency.

Figure 9:
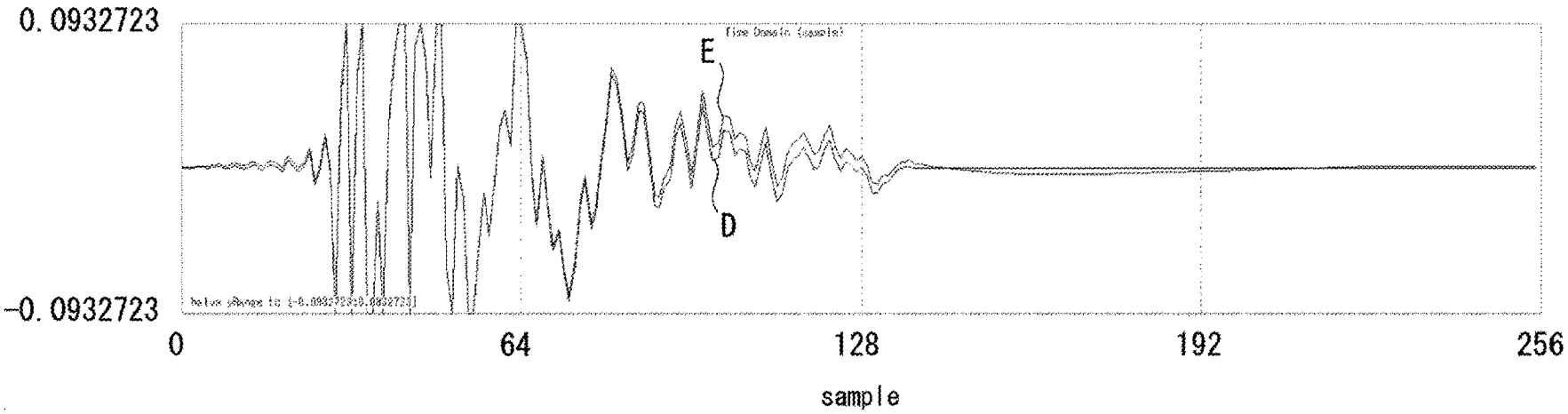
FIG. 9 is a waveform chart showing a direct sound signal and a corrected signal in an enlarged scale.

After that, the inverse transform unit 218 generates a corrected signal by IFFT (inverse fast Fourier transformation) (S17). Specifically, the inverse transform unit 218 performs discrete Fourier transform on the corrected amplitude spectrum and the phase spectrum, and thereby the spectrum data becomes time domain data. The inverse transform unit 218 may generate the corrected signal by performing inverse transform using inverse discrete cosine transform or the like, instead of inverse discrete Fourier transform. The number of samples of the corrected signal is the same as that of the direct sound signal, which is 2048. FIG. 9 shows the waveform chart showing a direct sound signal D and a corrected signal E in an enlarged scale.

Finally, the generation unit 219 generates filters by using the sound pickup signal and the corrected signal (S18). To be specific, the generation unit 219 replaces samples preceding the boundary sample d with the corrected signal. On the other hand, for samples subsequent to the boundary sample d, the generation unit 219 adds the corrected signal to the sound pickup signal. Specifically, the generation unit 219 generates filter values preceding the boundary sample d (0 to (d−1)) by the value of the corrected signal. On the other hand, the generation unit 219 generates filter values subsequent to the boundary sample d and preceding the second sample (d to 2047) by a value obtained by adding the corrected signal to the sound pickup signal. Further, the generation unit 219 generates filter values equal to or more than the second number of samples and less than the number of samples of the sound pickup signal by the value of the sound pickup signal.

For example, it is assumed that the sound pickup signal is M(n), the corrected signal is E(n), and the filter is F(n), where n is a sample number, which is an integer of 0 to 4095. The filter F(n) is as follows.

When n is equal to or more than 0 and less than d ($0 \le n < d$), $$F(n)=E(n)$$

When n is equal to or more than d and less than the second number of samples (2048 in this example) (d≤n<the second number of samples), $$F(n)=M(n)+E(n)$$

When n is equal to or more than the second number of samples and less than the number (4096 in this example) of samples of the sound pickup signal (the second number of samples≤n<the number of samples of the sound pickup signal), $$F(n)=M(n)$$

Figure 10:
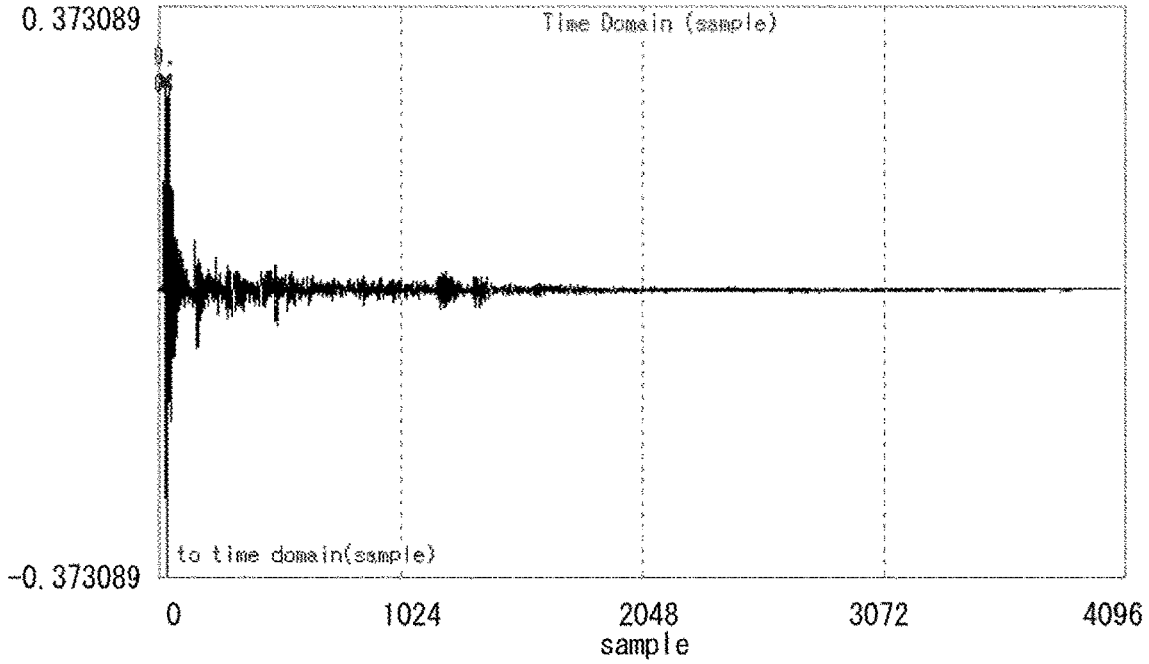
FIG. 10 is a waveform chart showing a filter obtained by processing in this embodiment.

Note that, if it is assumed that the value of the corrected signal E(n) when n is equal to or more than the second number of samples is 0, F(n)=M(n)+E(n) is satisfied when n is equal to or more than the second number of samples and less than the number (4096 in this example) of samples of the sound pickup signal. Thus, F(n)=M(n)+E(n) when n is equal to or more than d and less than the number (2048 in this example) of samples of the sound pickup signal. FIG. 10 shows the waveform chart of the filter. The number of samples of the filter is 4096.

Figure 11:
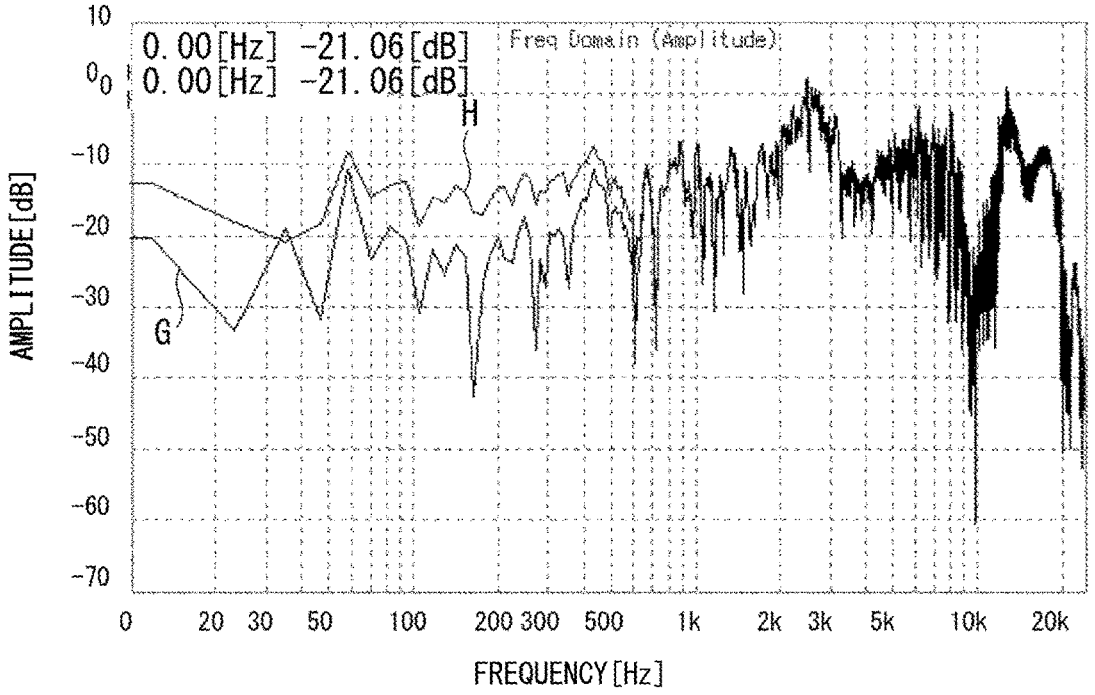
FIG. 11 is a view showing frequency characteristics of a corrected filter and an uncorrected filter.

In this manner, the generation unit 219 generates the filter by calculating the filter value based on the sound pickup signal and the corrected signal. The filter value may be obtained by adding the sound pickup signal and the corrected signal with multiplication of a coefficient, rather than simply adding the sound pickup signal and the corrected signal together. FIG. 11 shows the frequency characteristics (amplitude spectrum) of a filter H generated by the above-described processing and an uncorrected filter G. Note that the uncorrected filter G has the frequency characteristics of the sound pickup signal shown in FIG. 5.

As described above, by correcting the transfer characteristics, the sound fields where center sound images are appropriately localized and the frequency characteristics where mid and low frequencies and high frequencies are well balanced in a sense of listening are obtained. Specifically, because the amplitude of the correction band at low and mid frequencies is enhanced, an appropriate filter is generated. This achieves reproduction of sound fields without the problem of a low center channel volume. Further, an appropriate filter is generated even when the spatial transfer function at a fixed position on the head of the user U is measured. It is thus possible to obtain an appropriate filter value even for a frequency at which a difference between distances from a sound source to the left and right ears is a half-wavelength. An appropriate filter is thereby generated.

To be specific, the extraction unit 214 extracts samples preceding the boundary sample d. In other words, the extraction unit 214 extracts only the direct sound in the sound pickup signal. Thus, the samples extracted by the extraction unit 214 represent only the direct sound. The direct sound signal generation unit 215 generates the direct sound signal based on the extracted samples. Because the boundary sample d corresponds to the boundary between the direct sound and the reflected sound, it is possible to eliminate the reflected sound from the direct sound signal.

Further, the direct sound signal generation unit 215 generates the direct sound signal with the number of samples (2048) which is half the number of samples of the sound pickup signal and the filter. By increasing the number of samples of the direct sound signal, an accurate correction can be made in low frequencies. Further, the number of samples of the direct sound signal is preferably the number of samples with which the direct sound signal is 20 msec or longer. Note that the sample length of the direct sound signal may be the same as that of the sound pickup signal (the transfer characteristics Hls, Hlo, Hro and Hrs) at maximum.

The above-described processing is performed on four sound pickup signals corresponding to the transfer characteristics Hls, Hlo, Hro and Hrs. Note that the signal processor 201 is not limited to a single physical device. A part of the processing of the signal processor 201 may be performed in another device. For example, the sound pickup signal measured in another device is prepared, and the signal processor 201 acquires this sound pickup signal. Then, the signal processor 201 stores the sound pickup signal into a memory or the like and performs the above-described processing.

Second Embodiment

The signal processor 201 may automatically set the boundary sample d as described above. In this embodiment, the signal processor 201 performs processing for separating the direct sound and the reflected sound in order to set the boundary sample d. To be specific, the signal processor 201 calculates a separation boundary point that is somewhere between the end of the direct sound and the arrival of the initial reflected sound. Then, the boundary setting unit 213 described in the first embodiment sets the boundary sample d of the sound pickup signal based on the separation boundary point. For example, the boundary setting unit 213 may set the separation boundary point as the boundary sample d of the sound pickup signal, or may set a position shifted from the separation boundary point by a specified number of samples as the boundary sample d. The initial reflected sound is the reflected sound that reaches the ear 9 (microphone 2) earliest among the reflected sound reflected on an object such as a wall or a wall surface. Then, the transfer characteristics Hls, Hlo, Hro and Hrs are separated at the separation boundary point, and thereby the direct sound and the reflected sound are separated from each other. Specifically, the direct sound is contained in the signal (characteristics) preceding the separation boundary point, and the reflected sound is contained in the signal (characteristics) subsequent to the separation boundary point.

The signal processor 201 performs processing for calculating the separation boundary point for separating the direct sound and the initial reflected sound. To be specific, the signal processor 201 calculates a bottom time (bottom position) at some point from the direct sound to the initial reflected sound and a peak time (peak position) of the initial reflected sound in the sound pickup signal. The signal processor 201 then sets a search range for searching for the separation boundary point based on the bottom time and the peak time. The signal processor 201 calculates the separation boundary point based on the value of an evaluation function in the search range.

Figure 12:
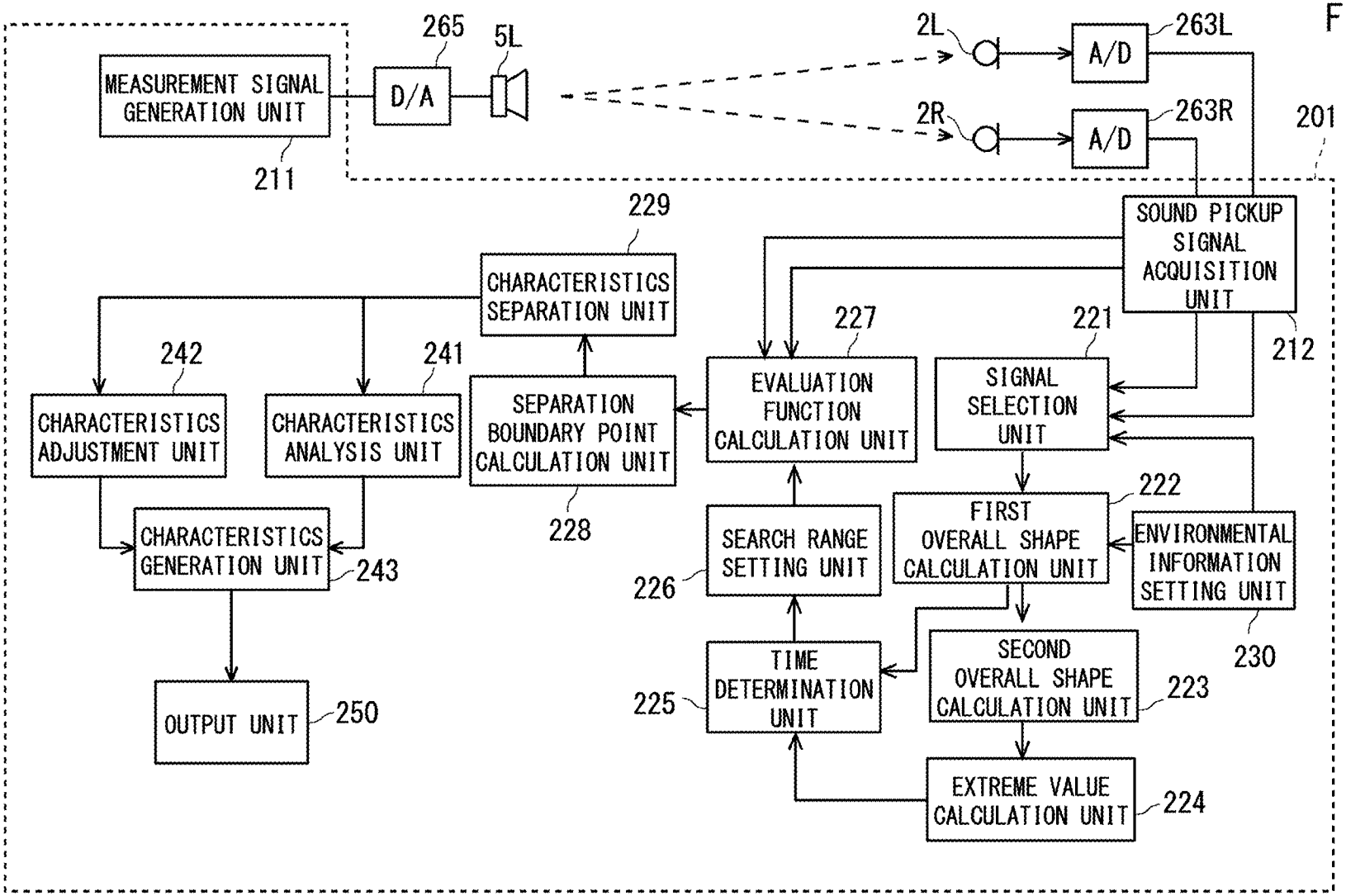
FIG. 12 is a control block diagram showing the structure of a signal processor according to a second embodiment.

The signal processor 201 of the filter generation device 200 and its processing are described in detail hereinbelow. FIG. 12 is a control block diagram showing the signal processor 201 of the filter generation device 200. Note that, because the filter generation device 200 performs the same measurement on each of the left speaker 5L and the right speaker 5R, the case where the left speaker 5L is used as the sound source is described below. Measurement using the right speaker 5R as the sound source can be performed in the same manner as measurement using the left speaker 5L as the sound source, and therefore the illustration of the right speaker 5R is omitted in FIG. 12.

The signal processor 201 includes a measurement signal generation unit 211, a sound pickup signal acquisition unit 212, a signal selection unit 221, a first overall shape calculation unit 222, a second overall shape calculation unit 223, an extreme value calculation unit 224, a time determination unit 225, a search range setting unit 226, an evaluation function calculation unit 227, a separation boundary point calculation unit 228, a characteristics separation unit 229, an environmental information setting unit 230, a characteristics analysis unit 241, a characteristics adjustment unit 242, a characteristics generation unit 243, and an output unit 250.

The signal processor 201 is an information processing device such as a personal computer or a smartphone, and it includes a memory and a CPU. The memory stores a processing program, parameters and measurement data. The CPU executes the processing program stored in the memory. As a result that the CPU executes the processing program, processing in the measurement signal generation unit 211, the sound pickup signal acquisition unit 212, the signal selection unit 221, the first overall shape calculation unit 222, the second overall shape calculation unit 223, the extreme value calculation unit 224, the search range setting unit 226, the evaluation function calculation unit 227, the separation boundary point calculation unit 228, the characteristics separation unit 229, the environmental information setting unit 230, the characteristics analysis unit 241, the characteristics adjustment unit 242, the characteristics generation unit 243 and the output unit 250 are performed.

The measurement signal generation unit 211 generates a measurement signal. The measurement signal generated by the measurement signal generation unit 211 is converted from digital to analog by a D/A converter 265 and output to the left speaker 5L. Note that the D/A converter 265 may be included in the signal processor 201 or the left speaker 5L. The left speaker 5L outputs a measurement signal for measuring the transfer characteristics. The measurement signal may be an impulse signal, a TSP (Time Stretched Pulse) signal or the like. The measurement signal contains a measurement sound such as an impulse sound.

Each of the left microphone 2L and the right microphone 2R of the stereo microphones 2 picks up the measurement signal, and outputs the sound pickup signal to the signal processor 201. The sound pickup signal acquisition unit 212 acquires the sound pickup signals from the left microphone 2L and the right microphone 2R. The sound pickup signals from the microphones 2L and 2R are converted from analog to digital by A/D converters 263L and 263R and input to the sound pickup signal acquisition unit 212. The sound pickup signal acquisition unit 212 may perform synchronous addition of the signals obtained by a plurality of times of measurement. Because an impulse sound output from the left speaker 5L is picked up in this example, the sound pickup signal acquisition unit 212 acquires the sound pickup signal corresponding to the transfer characteristics Hls and the sound pickup signal corresponding to the transfer characteristics Hlo.

Figure 13:
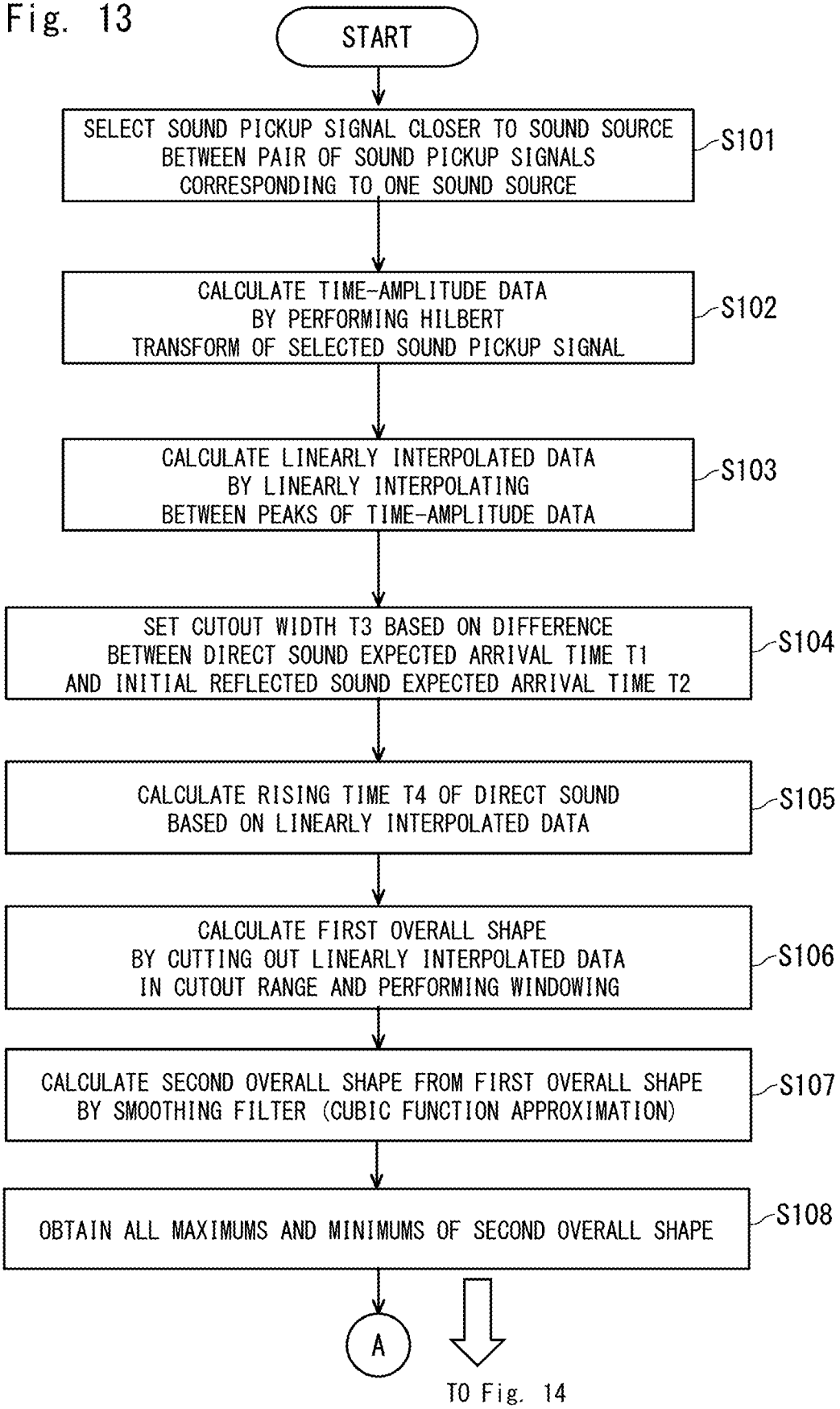
FIG. 13 is a flowchart showing a signal processing method in the signal processor according to the second embodiment.
Figure 14:
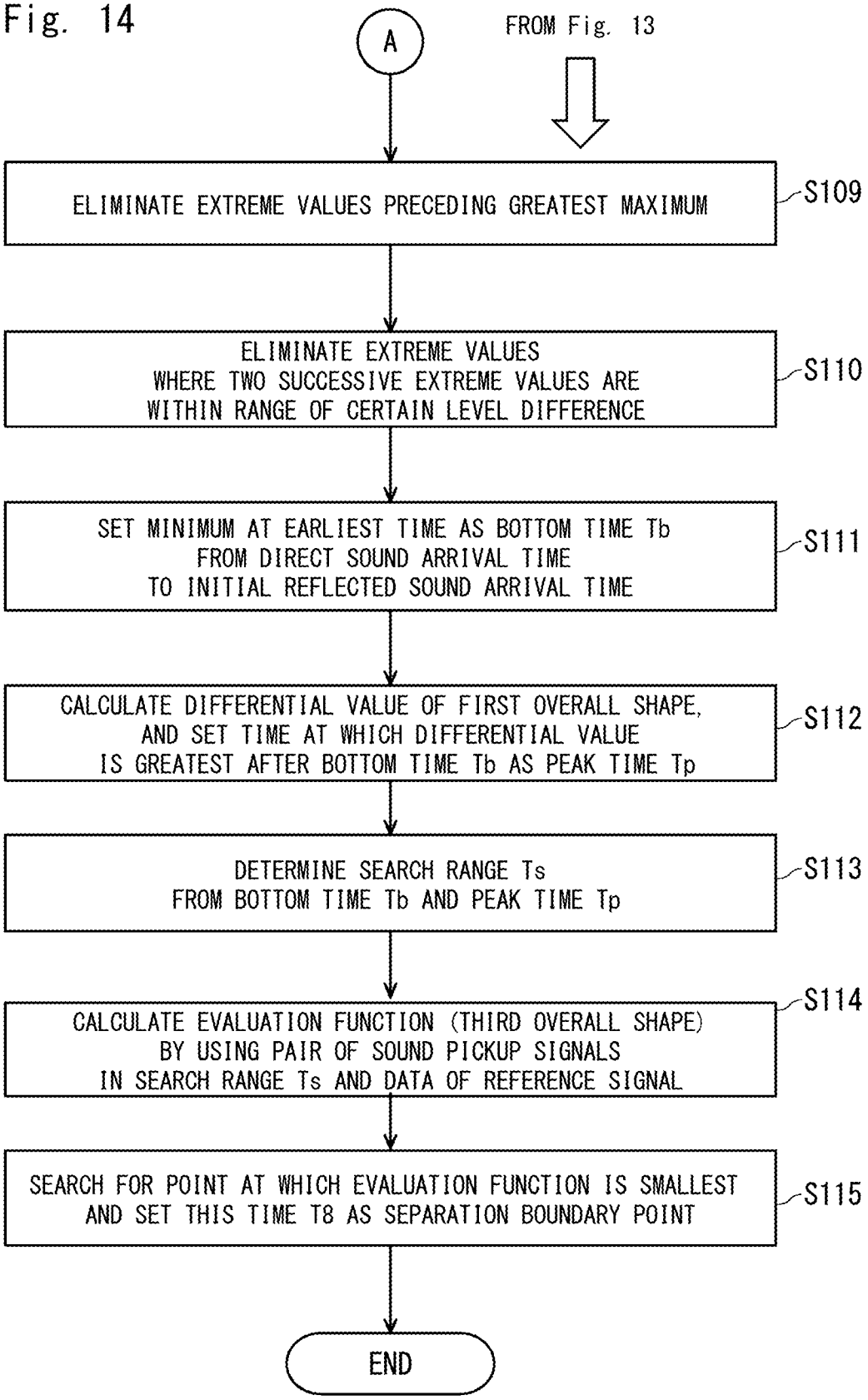
FIG. 14 is a flowchart showing a signal processing method in the signal processor according to the second embodiment.
Figure 15:
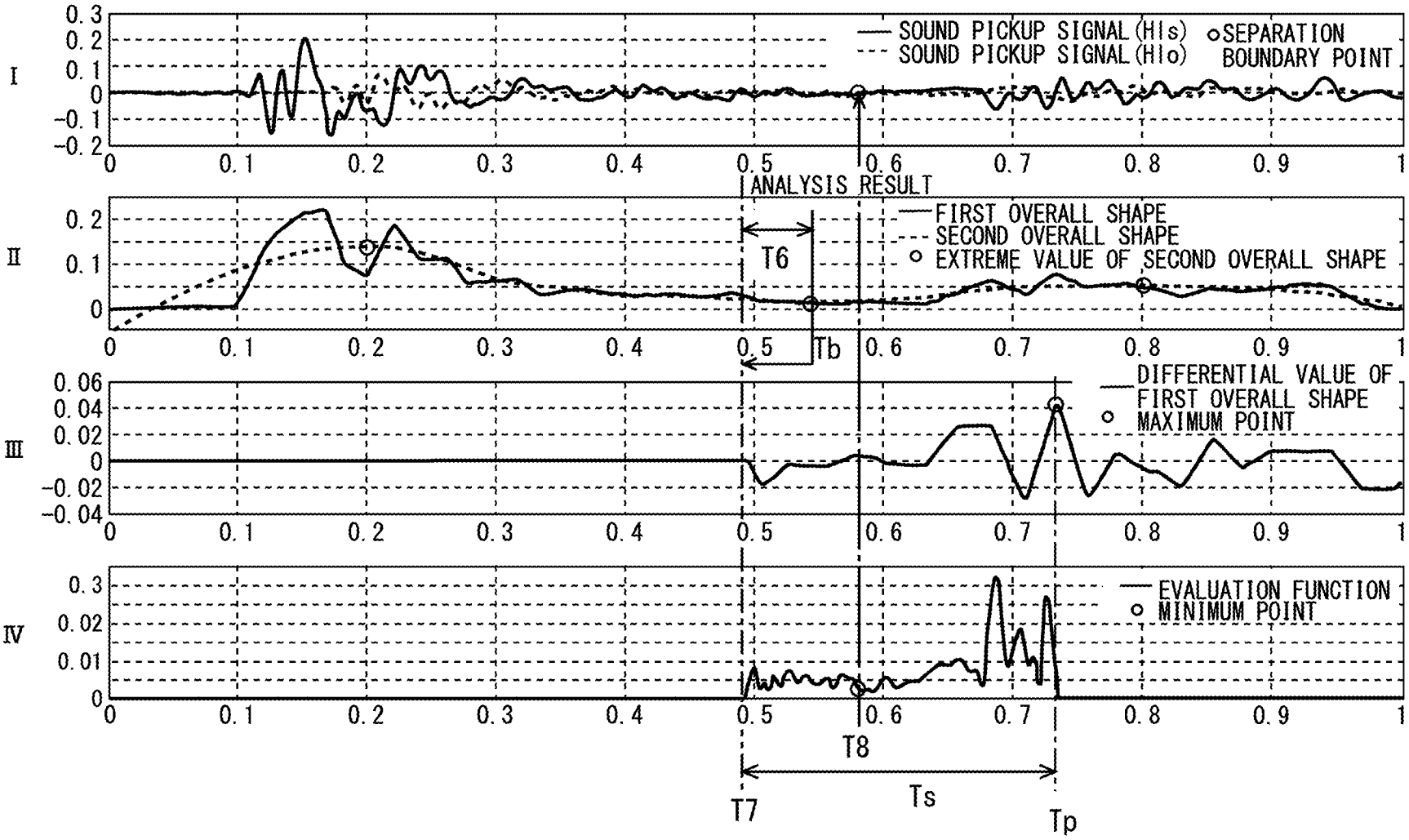
FIG. 15 is a waveform chart illustrating processing in the signal processor.

Signal processing in the signal processor 201 is described hereinafter with reference to FIGS. 13 to 15 in addition to FIG. 12. FIGS. 13 and 14 are flowcharts showing a signal processing method. FIG. 15 is a waveform chart showing signals in each processing. In FIG. 15, the horizontal axis indicates a time, and vertical axis indicates a signal intensity. Note that the horizontal axis (time axis) is normalized in such a way that the time of the first data is 0, and the time of the last data is 1.

First, the signal selection unit 221 selects the sound pickup signal that is closer to the sound source between a pair of sound pickup signals acquired by the sound pickup signal acquisition unit 212 (S101). Because the left microphone 2L is closer to the left speaker 5L than the right microphone 2R is, the signal selection unit 221 selects the sound pickup signal corresponding to the transfer characteristics Hls. As shown in the graph I of FIG. 15, the direct sound arrives earlier at the microphone 2L that is closer to the sound source (the speaker 5L) than at the microphone 2R. Therefore, by comparing the arrival time when the sound arrives earlier between two sound pickup signals, it is possible to select the sound pickup signal that is closer to the sound source. Environmental information from the environmental information setting unit 230 may be input to the signal selection unit 221, and the signal selection unit 221 may check a selection result against the environmental information.

The first overall shape calculation unit 222 calculates a first overall shape based on time-amplitude data of the sound pickup signal. To calculate the first overall shape, the first overall shape calculation unit 222 first performs Hilbert transform of the selected sound pickup signal and thereby calculates time-amplitude data (S102). Next, the first overall shape calculation unit 222 linearly interpolates between peaks (maximums) of the time-amplitude data and thereby calculates linearly interpolated data (S103).

Then, the first overall shape calculation unit 222 sets a cutout width T3 based on an expected arrival time T1 of the direct sound and an expected arrival time T2 of the initial reflected sound (S104). Environmental information related to the measurement environment is input from the environmental information setting unit 230 to the first overall shape calculation unit 222. The environmental information contains geometric information related to the measurement environment. For example, one or more information of the distance and angle from the user U to the speaker 5L, the distance from the user U to both wall surfaces, the installation height of the speaker 5L, the ceiling height, and the ground height of the user U. The first overall shape calculation unit 222 predicts the expected arrival time T1 of the direct sound and the expected arrival time T2 of the initial reflected sound by using the environmental information. The first overall shape calculation unit 222 sets a value that is twice the difference between the two expected arrival times as the cutout width T3. Thus, the cutout width $T3=2\times(T2-T1)$. Note that the cutout width T3 may be previously set to the environmental information setting unit 230.

The first overall shape calculation unit 222 calculates a rising time T4 of the direct sound based on the linearly interpolated data (S105). For example, the first overall shape calculation unit 222 may set the time (position) of the earliest peak (maximum) in the linearly interpolated data as the rising time T4.

The first overall shape calculation unit 222 cuts out the linearly interpolated data in the cutout range and performs windowing, and thereby calculates a first overall shape (S106). For example, a time that is earlier than the rising time T4 by a specified interval is a cutout start time T5. Then, setting a time period with the cutout width T3 from the cutout start time T5 as the cutout range, the linearly interpolated data is cut out. The first overall shape calculation unit 222 cuts out the linearly interpolated data with the cut out range from T5 to (T5+T3) and thereby calculates cutout data. Then, the first overall shape calculation unit 222 performs windowing in such a way that the both ends of the data converge to 0 outside the cutout range and thereby calculates the first overall shape. The graph II in FIG. 15 shows the waveform of the first overall shape.

The second overall shape calculation unit 223 calculates a second overall shape from the first overall shape by a smoothing filter (cubic function approximation) (S107). Specifically, the second overall shape calculation unit 223 performs smoothing on the first overall shape and thereby calculates the second overall shape. In this example, the second overall shape calculation unit 223 uses data obtained by smoothing the first overall shape by cubic function approximation as the second overall shape. The graph II in FIG. 15 shows the waveform of the second overall shape. The second overall shape calculation unit 223, however, may calculate the second overall by using a smoothing filter other than the cubic function approximation.

The extreme value calculation unit 224 obtains all maximums and minimums of the second overall shape (S108). The extreme value calculation unit 224 then eliminates extreme values preceding the greatest maximum (S109). The greatest maximum corresponds to the peak of the direct sound. The extreme value calculation unit 224 eliminates extreme values where the two successive extreme values are within the range of a certain level difference (S110). The extreme value calculation unit 224 extracts the extreme values in this manner. The graph II in FIG. 15 shows the extreme values extracted from the second overall shape. The extreme value calculation unit 224 extracts the minimums, which are candidates for a bottom time Tb.

For example, numerical examples arranged in the sequence of 0.8 (maximum), 0.5 (minimum), 0.54 (maximum), 0.2 (minimum), 0.3 (maximum), and 0.1 (minimum) from the earliest to the latest are described. When a certain level difference (threshold) is 0.05, the two successive extreme values have the certain level difference or less in a pair of [0.5 (minimum), 0.54 (maximum)]. As a result, the extreme value calculation unit 224 eliminates the extreme values of 0.5 (minimum) and 0.54 (maximum). The extreme values remaining without being eliminated are 0.8 (maximum), 0.2 (minimum), 0.3 (maximum), and 0.1 (minimum) from the earliest to the latest. In this manner, the extreme value calculation unit 224 eliminates unnecessary extreme values. By eliminating the extreme values where the two successive extreme values have a certain level difference or less, it is possible to extract only appropriate extreme values.

The time determination unit 225 calculates the bottom time Tb at some point from the direct sound to the initial reflected sound and the peak time Tp of the initial reflected sound based on the first overall shape and the second overall shape. To be specific, the time determination unit 225 sets the time (position) of the minimum at the earliest time among the extreme values of the second overall shape obtained by the extreme value calculation unit 224 as the bottom time Tb (S111). Specifically, the time of the minimum at the earliest time among the extreme values of the second overall shape not eliminated by the extreme value calculation unit 224 is the bottom time Tb. The graph II in FIG. 15 shows the bottom time Tb. In the above numerical examples, the time of 0.2 (minimum) is the bottom time Tb.

The time determination unit 225 calculates a differential value of the first overall shape, and sets a time at which the differential value reaches its maximum after the bottom time Tb as the peak time Tp (S112). The graph III in FIG. 15 shows the waveform of the differential value of the first overall shape and its maximum point. As shown in the graph III, the maximum point of the differential value of the first overall shape is the peak time Tp.

The search range setting unit 226 determines a search range Ts from the bottom time Tb and the peak time Tp (S113). For example, the search range setting unit 226 sets a time that is earlier than the bottom time Tb by a specified time T6 as a search start time T7 (=Tb-T6), and sets the peak time Tp as a search end time. In this case, the search range Ts is from T7 to Tp.

Then, the evaluation function calculation unit 227 calculates an evaluation function (third overall shape) by using a pair of sound pickup signals in the search range Ts and data of a reference signal (S114). Note that the pair of sound pickup signals includes the sound pickup signal corresponding to the transfer characteristics Hls and the sound pickup signal corresponding to the transfer characteristics Hlo. The reference signal is a signal where values in the search range Ts are all 0. Then, the evaluation function calculation unit 227 calculates the average of absolute values and a sample standard deviation based on three signals, i.e., the two sound pickup signals and one reference signal.

For example, the absolute value of the sound pickup signal of the transfer characteristics Hls at the time T is $ABS_{Hls}(t)$, the absolute value of the sound pickup signal of the transfer characteristics Hlo is $ABS_{Hlo}(t)$, and the absolute value of the reference signal is $ABS_{Ref}(t)$. The average of the three absolute values is $ABS_{ave}=(ABS_{Hls}(t)+ABS_{Hlo}(t)+ABS_{Hls}(t))/3$. Further, the sample standard deviation of the three absolute values $ABS_{Hls}(t)$, $ABS_{Hlo}(t)$ and $ABS_{Ref}(t)$ is $\sigma(t)$. Then, the evaluation function calculation unit 227 sets the sum $(ABS_{ave}(t)+\sigma(t))$ of the average of the absolute values $ABS_{ave}$ and the sample standard deviation $\sigma(t)$ as the evaluation function. The evaluation function is a signal that varies according to the time in the search range Ts. The graph IV in FIG. 15 shows the evaluation function.

The separation boundary point calculation unit 228 searches for a point at which the evaluation function reaches its minimum and sets this time as the separation boundary point (S115). The graph IV in FIG. 15 shows the point at which the evaluation function reaches its minimum (T8). In this manner, it is possible to calculate the separation boundary point for appropriately separating the direct sound and the initial reflected sound. By calculating the evaluation function with use of the reference signal, it is possible to set the point at which a pair of sound pickup signals is close to 0 as the separation boundary point.

Then, the characteristics separation unit 229 separates a pair of sound pickup signals at the separation boundary point. The sound pickup signal is thereby separated to the transfer characteristics (signal) containing the direct sound and the transfer characteristics (signal) containing the initial reflected sound. Specifically, the signal preceding the separation boundary point indicates the transfer characteristics of the direct sound. In the signal subsequent to the separation boundary point, the transfer characteristics of the reflected sound reflected on an object such as a wall surface or a floor surface are dominant.

The characteristics analysis unit 241 analyzes the frequency characteristics or the like of the signals preceding and subsequent to the separation boundary point. The characteristics analysis unit 241 calculates the frequency characteristics by discrete Fourier transform or discrete cosine transform. The characteristics adjustment unit 242 adjusts the frequency characteristics or the like of the signals preceding and subsequent to the separation boundary point. For example, the characteristics adjustment unit 242 may adjust the amplitude or the like in the responsive frequency band to either one of the signals preceding and subsequent to the separation boundary point. The characteristics generation unit 243 generates the transfer characteristics by synthesizing the characteristics analyzed and adjusted by the characteristics analysis unit 241 and the characteristics adjustment unit 242.

For the processing in the characteristics analysis unit 241, the characteristics adjustment unit 242 and the characteristics generation unit 243, a known technique or a technique described in the first embodiment may be used, and the description thereof is omitted. The transfer characteristics generated in the characteristics generation unit 243 serve as filters corresponding to the transfer characteristics Hls and Hlo. Then, the output unit 250 outputs the characteristics generated by the characteristics generation unit 243 as filters to the out-of-head localization device 100.

As described above, in this embodiment, the sound pickup signal acquisition unit 212 acquires the sound pickup signal containing the direct sound that directly reaches the microphone 2L from the left speaker 5L, which is the sound source, and the reflected sound. The first overall shape calculation unit 222 calculates the first overall shape based on the time-amplitude data of the sound pickup signal. The second overall shape calculation unit 223 smoothes the first overall shape and thereby calculates the second overall shape of the sound pickup signal. The time determination unit 225 determines the bottom time (bottom position) at some point from the direct sound to the initial reflected sound of the sound pickup signal and the peak time (peak position) of the initial reflected sound based on the first and second overall shapes.

The time determination unit 225 can appropriately calculate the bottom time at some point between the direct sound and the initial reflected sound of the sound pickup signal and the peak time of the initial reflected sound. In other words, it is possible to appropriately calculate the bottom time and the peak time, which are information for appropriately separating the direct sound and the reflected sound. The sound pickup signal is thereby appropriately processed according to this embodiment.

Further, in this embodiment, the first overall shape calculation unit 222 performs Hilbert transform of the sound pickup signal in order to obtain the time-amplitude data of the sound pickup signal. Then, to obtain the first overall shape, the first overall shape calculation unit 222 interpolates between the peaks of the time-amplitude data. The first overall shape calculation unit 222 performs windowing in such a way that both ends of the interpolated data where the peaks are interpolated converge to 0. It is thereby possible to appropriately obtain the first overall shape in order to calculate the bottom time Tb and the peak time Tp.

The second overall shape calculation unit 223 calculates the second overall shape by performing smoothing using cubic function approximation or the like on the first overall shape. It is thereby possible to appropriately obtain the second overall shape for calculating the bottom time Tb and the peak time Tp. Note that an approximate expression for calculating the second overall shape may be a polynomial other than the cubic function or another function.

The search range Ts is set based on the bottom time Tb and the peak time Tp. The separation boundary point is thereby appropriately calculated. Further, it is possible to calculate the separation boundary point automatically by a computer program or the like. Particularly, appropriate separation is possible even in the measurement environment where the initial reflected sound arrives at the timing when the reflected sound does not converge.

Further, in this embodiment, environmental information related to the measurement environment is set in the environmental information setting unit 230. Then, the cutout width T3 is set based on the environmental information. It is thereby possible to more appropriately calculate the bottom time Tb and the peak time Tp.

The evaluation function calculation unit 227 calculates the evaluation function based on the sound pickup signals acquired by the two microphones 2L and 2R. An appropriate evaluation function is thereby calculated. It is thus possible to obtain the appropriate separation boundary point also for the sound pickup signal of the microphone 2R that is far from the sound source. When picking up the sound from the sound source by three or more microphones, the evaluation function may be calculated by three or more sound pickup signals.

Further, the evaluation function calculation unit 227 may calculate the evaluation function for each sound pickup signal. In this case, the separation boundary point calculation unit 228 calculates the separation boundary point for each sound pickup signal. It is thereby possible to determine the appropriate separation boundary point for each sound pickup signal. For example, in the search range Ts, the evaluation function calculation unit 227 calculates the absolute value of the sound pickup signal as the evaluation function. The separation boundary point calculation unit 228 may set a point at which the evaluation function reaches its minimum as the separation boundary point. The separation boundary point calculation unit 228 may set a point at which variation of the evaluation function is small as the separation boundary point.

In the right speaker 5R, the same processing as in the left speaker 5L is performed. The filters in the convolution calculation units 11 to 12 and 21 to 22 shown in FIG. 1 are thereby obtained. It is thereby possible to perform accurate out-of-head localization.

Third Embodiment

Figure 16:
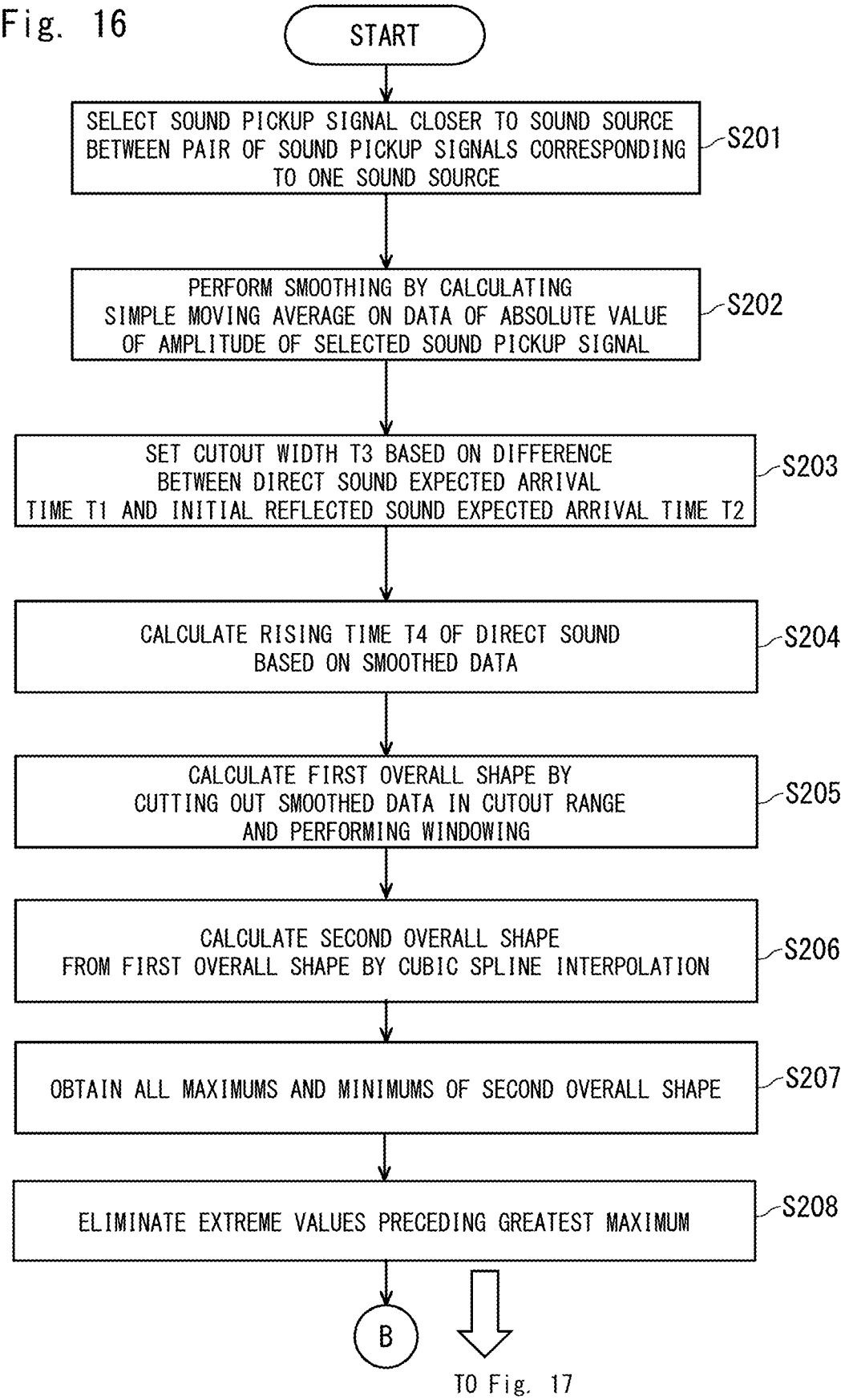
FIG. 16 is a flowchart showing a signal processing method in a signal processor according to a third embodiment.
Figure 17:
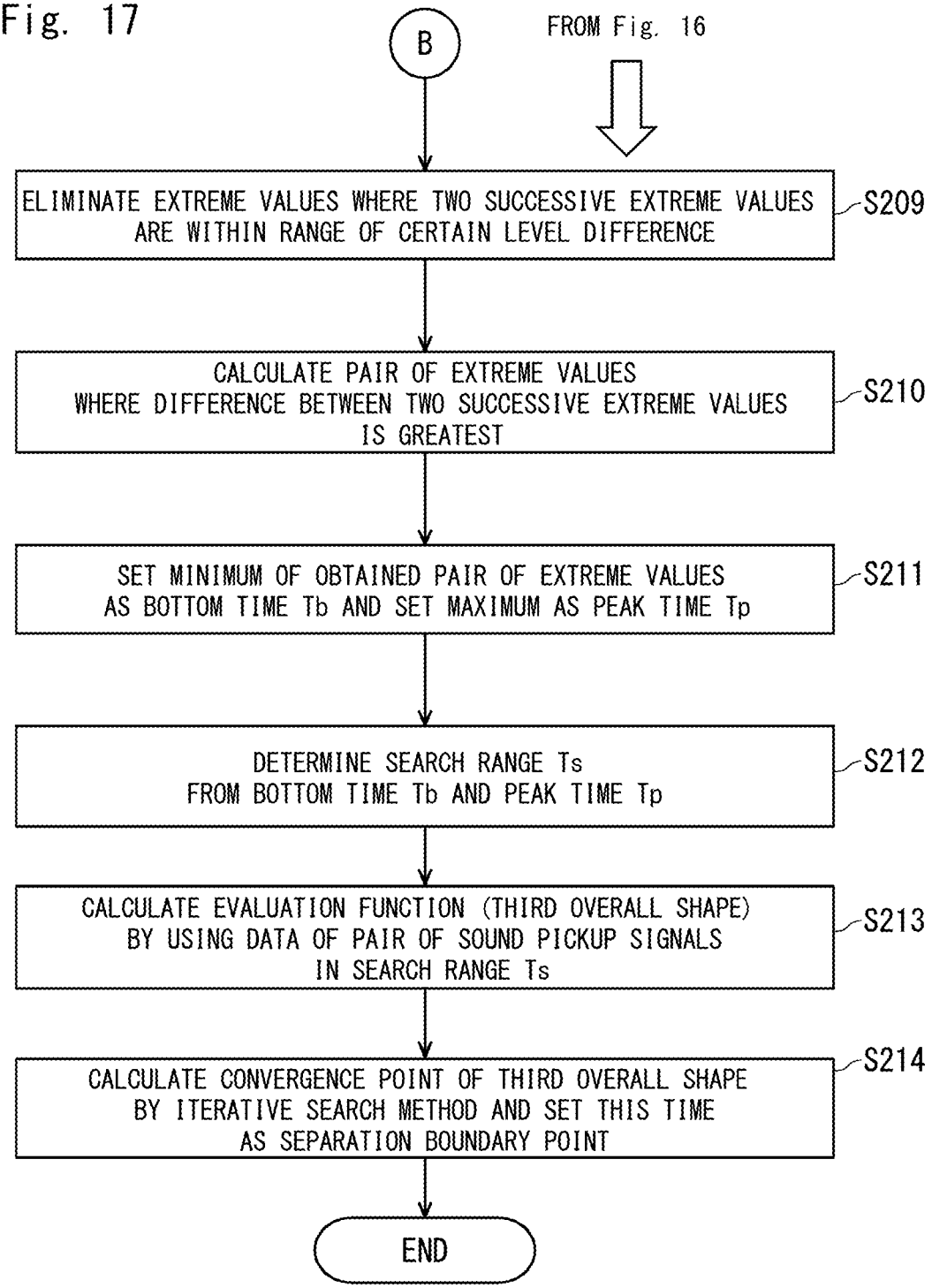
FIG. 17 is a flowchart showing a signal processing method in the signal processor according to the third embodiment.
Figure 18:
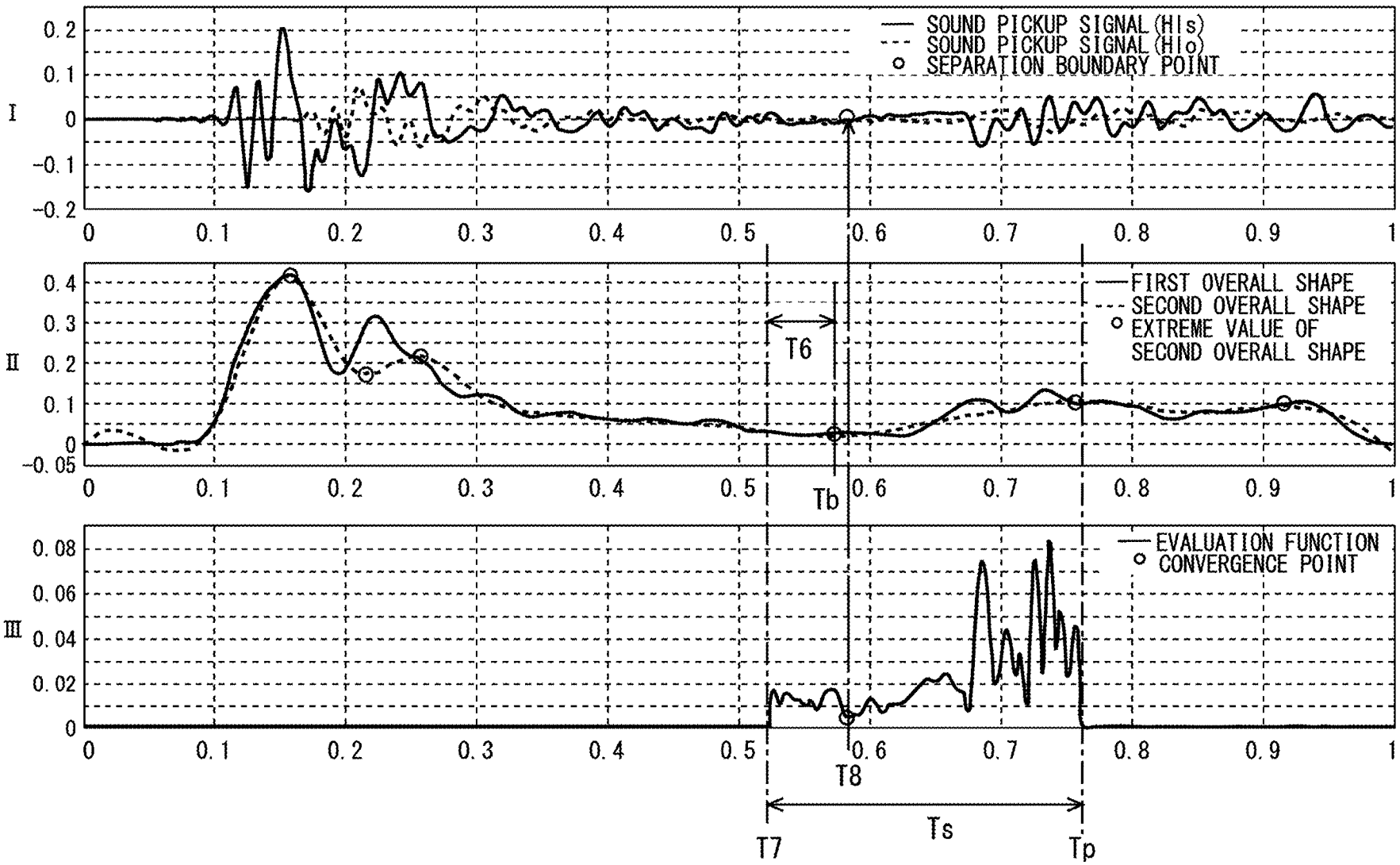
FIG. 18 is a waveform chart illustrating processing in the signal processor.

A signal processing method according to this embodiment is described hereinafter with reference to FIGS. 16 to 18. FIGS. 16 and 17 show flowcharts showing the signal processing method according to the third embodiment. FIG. 18 is a view showing the waveform for illustrating each processing. Note that the structures of the filter generation device 200, the signal processor 201 and the like in the third embodiment are the same as those of FIGS. 2 and 12 described in the first and second embodiments, and the description thereof is omitted.

This embodiment is different from the second embodiment in the processing or the like in the first overall shape calculation unit 222, the second overall shape calculation unit 223, the time determination unit 225, the evaluation function calculation unit 227 and the separation boundary point calculation unit 228. The description of the same processing as in the second embodiment is omitted as appropriate. For example, the processing of the extreme value calculation unit 224, the characteristics separation unit 229, the characteristics analysis unit 241, the characteristics adjustment unit 242, the characteristics generation unit 243 and the like is the same as the processing in the second embodiment, and the detailed description thereof is omitted.

First, the signal selection unit 221 selects the sound pickup signal that is closer to the sound source between a pair of sound pickup signals acquired by the sound pickup signal acquisition unit 212 (S201). The signal selection unit 221 thereby selects the sound pickup signal corresponding to the transfer characteristics Hls as in the second embodiment. The graph I of FIG. 18 shows a pair of sound pickup signals.

The first overall shape calculation unit 222 calculates the first overall shape based on time-amplitude data of the sound pickup signal. To calculate the first overall shape, the first overall shape calculation unit 222 first performs smoothing by calculating a simple moving average on data of the absolute value of the amplitude of the selected sound pickup signal (S202). The data of the absolute value of the amplitude of the sound pickup signal is referred to as time-amplitude data. Data obtained by smoothing the time-amplitude data is referred to as smoothed data. Note that a method of smoothing is not limited to the simple moving average.

The first overall shape calculation unit 222 sets a cutout width T3 based on an expected arrival time T1 of the direct sound and an expected arrival time T2 of the initial reflected sound (S203). The cutout width T3 may be set based on environmental information, just like in the step S104.

The first overall shape calculation unit 222 calculates a rising time T4 of the direct sound based on the smoothed data (S204). For example, the first overall shape calculation unit 222 may set the position (time) of the earliest peak (maximum) in the smoothed data as the rising time T4.

The first overall shape calculation unit 222 cuts out the smoothed data in the cutout range and performs windowing, and thereby calculates a first overall shape (S205). The processing in S205 is the same as the processing in S106, and the description thereof is omitted. The graph II in FIG. 18 shows the waveform of the first overall shape.

The second overall shape calculation unit 223 calculates a second overall shape from the first overall shape by cubic spline interpolation (S206). Specifically, the second overall shape calculation unit 223 smoothes the first overall shape by applying cubic spline interpolation and thereby calculates the second overall shape. The graph II in FIG. 18 shows the waveform of the second overall shape. The second overall shape calculation unit 223, however, may smooth the first overall shape by using a method other than cubic spline interpolation. For example, a method of smoothing is not particularly limited, and B-spline interpolation, approximation by a Bezier curve, Lagrange interpolation, smoothing by a Savitzky-Golay filter and the like may be used.

The extreme value calculation unit 224 obtains all maximums and minimums of the second overall shape (S207). The extreme value calculation unit 224 then eliminates extreme values preceding the greatest maximum (S208). The greatest maximum corresponds to the peak of the direct sound. The extreme value calculation unit 224 eliminates extreme values where the two successive extreme values are within the range of a certain level difference (S209). The minimums, which are candidates for a bottom time Tb, and the maximums, which are candidates of a peak time Tp, are thereby obtained. The processing of S207 to S209 is the same as the processing in S108 to S110, and the description thereof is omitted. The graph II in FIG. 18 shows the extreme values of the second overall shape.

After that, the time determination unit 225 calculates a pair of extreme values where a difference between the two successive extreme values is greatest (S210). The difference between the extreme values is a value defined by a slope in the time axis direction. The pair of extreme values obtained by the time determination unit 225 is in the sequence where the maximum follows the minimum. Specifically, because a difference between the extreme values is negative in the sequence where the minimum follows the maximum, the pair of extreme values obtained by the time determination unit 225 is in the sequence where the maximum follows the minimum.

The time determination unit 225 sets the time of the minimum of the obtained pair of extreme values as the bottom time Tb from the direct sound to the initial reflected sound, and sets the time of the maximum as the peak time Tp of the initial reflected sound (S211). The graph III in FIG. 18 shows the bottom time Tb and the peak time Tp.

The search range setting unit 226 determines a search range Ts from the bottom time Tb and the peak time Tp (S212). For example, the search range setting unit 226 sets a time that is earlier than the bottom time Tb by a specified time T6 as a search start time T7 (=Tb−T6), and sets the peak time Tp as a search end time, just like in S113.

The evaluation function calculation unit 227 calculates an evaluation function (third overall shape) by using data of a pair of sound pickup signals in the search range Ts (S213). Note that the pair of sound pickup signals includes the sound pickup signal corresponding to the transfer characteristics Hls and the sound pickup signal corresponding to the transfer characteristics Hlo. Thus, this embodiment is different from the second embodiment in that the evaluation function calculation unit 227 calculates the evaluation function without using the reference signal.

In this example, the sum of the absolute values of the pair of sound pickup signals is used as the evaluation function. For example, it is assumed that the absolute value of the sound pickup signal of the transfer characteristics Hls at the time T is $ABS_{Hls}(t)$, and the absolute value of the sound pickup signal of the transfer characteristics Hlo is $ABS_{Hlo}(t)$. The evaluation function is $ABS_{Hls}(t)+ABS_{Hlo}(t)$. The graph III in FIG. 18 shows the evaluation function.

The separation boundary point calculation unit 228 calculates a convergence point of the evaluation function by an iterative search method, and sets this time as the separation boundary point (S214). The graph III in FIG. 18 shows a time T8 at the convergence point of the evaluation function. For example, in this embodiment, the separation boundary point calculation unit 228 calculates the separation boundary point by performing the iterative search as follows:

(1) extract data with a certain window width from the beginning of the search range Ts and calculates the sum;

(2) shift the window along the time axis and sequentially calculate the sum of data with a window width;

(3) determine the window position at which the calculated sum is smallest, cut out the data, and set it as a new search range; and (4) repeat the processing of (1) to (3) until the convergence point is obtained.

Figure 19:
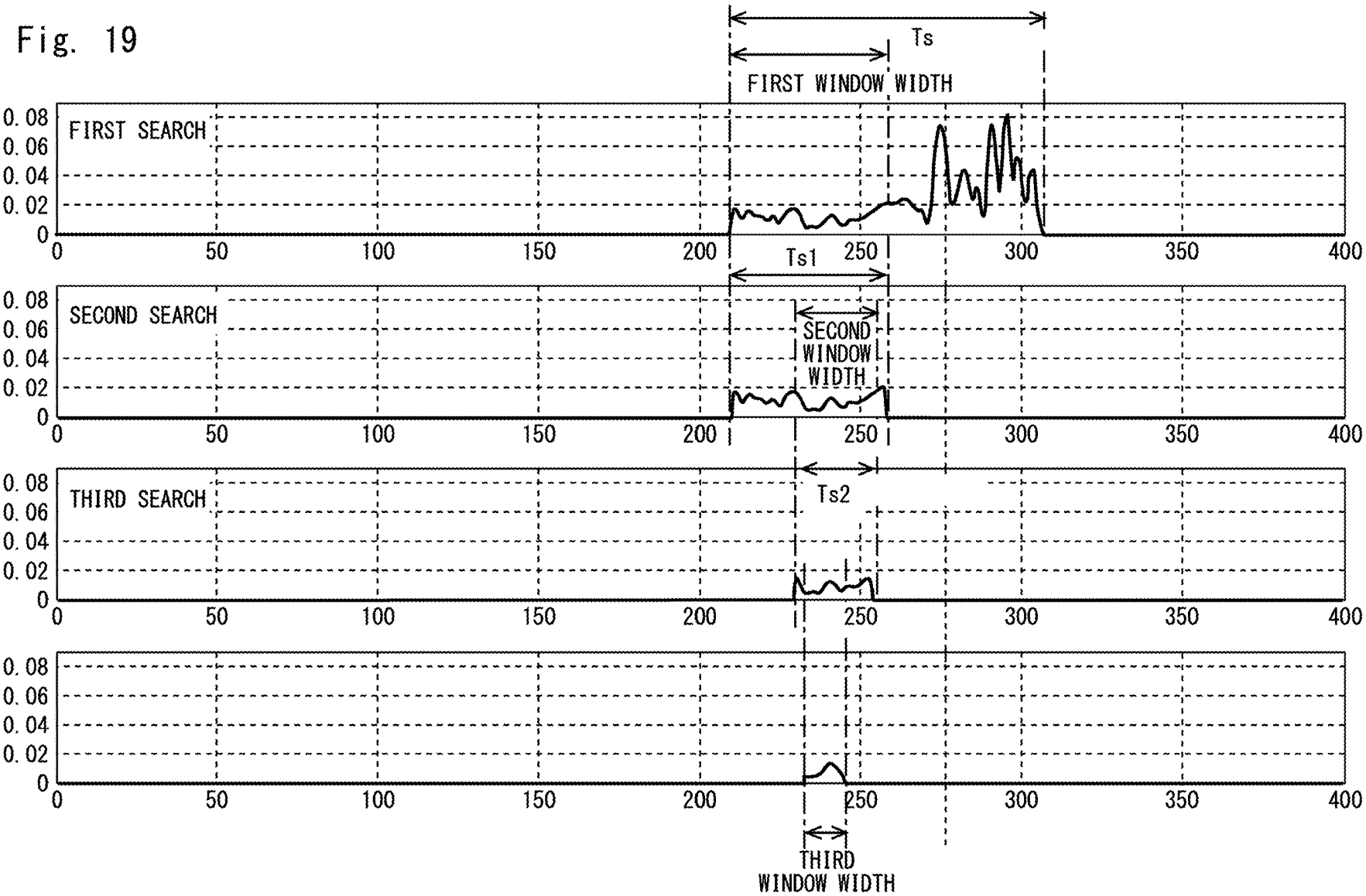
FIG. 19 is a waveform chart illustrating processing of obtaining a convergence point by an iterative search method.

By using the iterative search method, it is possible to set a time at which variation of the evaluation function is small as the separation boundary point. FIG. 19 is a waveform showing data cut out by the iterative search method. FIG. 19 shows the waveform obtained by processing of repeating the first search to the third search. Note that, in FIG. 19, the time axis in the horizontal axis is indicated by the number of samples.

In the first search, the separation boundary point calculation unit 228 sequentially calculates the sum with a first window width in the search range Ts. In the second search, the separation boundary point calculation unit 228 sets the first window width at the window position obtained in the first search as a search range Ts1, and sequentially calculates the sum with a second window width in this search range. Note that the second window width is narrower than the first window width.

Likewise, in the third search, the separation boundary point calculation unit 228 sets the second window width at the window position obtained in the second search as a search range Ts2, and sequentially calculates the sum with a third window width in this search range. Note that the third window width is narrower than the second window width. The window width in each search may be any value as long as it is appropriately set. Further, the window width may be changed each time the search is repeated. Further, the minimum value of the evaluation function may be set as the separation boundary point, just like in the second embodiment.

As described above, in this embodiment, the sound pickup signal acquisition unit 212 acquires the sound pickup signal containing the direct sound that directly reaches the microphone 2L from the left speaker 5L, which is the sound source, and the reflected sound. The first overall shape calculation unit 222 calculates the first overall shape based on the time-amplitude data of the sound pickup signal. The second overall shape calculation unit 223 smoothes the first overall shape and thereby calculates the second overall shape of the sound pickup signal. The time determination unit 225 determines the bottom time (bottom position) at some point from the direct sound to the initial reflected sound of the sound pickup signal and the peak time (peak position) of the initial reflected sound based on the second overall shape.

The bottom time at some point from the direct sound to the initial reflected sound of the sound pickup signal and the peak time of the initial reflected sound are thereby appropriately calculated. In other words, it is possible to appropriately calculate the bottom time and the peak time, which are information for appropriately separating the direct sound and the initial reflected sound. In this manner, the processing of the third embodiment ensures appropriate processing of the sound pickup signal, just like the second embodiment.

Note that the time determination unit 225 may appropriately calculate the bottom time Tb and the peak time Tp based on at least one of the first overall shape and the second overall shape. To be specific, the peak time Tp may be determined based on the first overall shape as described in the second embodiment, or may be determined based on the second overall shape as described in the third embodiment. Further, although the time determination unit 225 determines the bottom time Tb based on the second overall shape in the second and third embodiments, the bottom time Tb may be determined based on the first overall shape.

It should be noted that the processing of the second embodiment and the processing of the third embodiment may be combined as appropriate. For example, the processing of the first overall shape calculation unit 222 in the second embodiment may be used instead of the processing of the first overall shape calculation unit 222 in the third embodiment. Likewise, the processing of the second overall shape calculation unit 223, the extreme value calculation unit 224, the time determination unit 225, the search range setting unit 226, the evaluation function calculation unit 227 or the separation boundary point calculation unit 228 in the third embodiment may be used instead of the processing of the second overall shape calculation unit 223, the extreme value calculation unit 224, the time determination unit 225, the search range setting unit 226, the evaluation function calculation unit 227 or the separation boundary point calculation unit 228 in the second embodiment.

Alternatively, the processing of the first overall shape calculation unit 222, the second overall shape calculation unit 223, the extreme value calculation unit 224, the time determination unit 225, the search range setting unit 226, the evaluation function calculation unit 227 or the separation boundary point calculation unit 228 in the second embodiment may be used instead of the processing of the first overall shape calculation unit 222, the second overall shape calculation unit 223, the extreme value calculation unit 224, the time determination unit 225, the search range setting unit 226, the evaluation function calculation unit 227 or the separation boundary point calculation unit 228 in the third embodiment. In this manner, at least one of the processing of the first overall shape calculation unit 222, the second overall shape calculation unit 223, the extreme value calculation unit 224, the time determination unit 225, the search range setting unit 226, the evaluation function calculation unit 227 and the separation boundary point calculation unit 228 may be replaced between the second embodiment and the third embodiment and performed.

The boundary setting unit 213 can set the boundary between the direct sound and the reflected sound based on the separation boundary point calculated in the second or third embodiment. The boundary setting unit 213, however, may set the boundary between the direct sound and the reflected sound based on the separation boundary point calculated by a technique other than the second or third embodiment.

The separation boundary point calculated in the second or third embodiment may be used for processing other than the processing in the boundary setting unit 213. In this case, the signal processing device according to the second or third embodiment includes a sound pickup signal acquisition unit that acquires a sound pickup signal containing direct sound that directly reaches a microphone from a sound source and reflected sound, a first overall shape calculation unit that calculates a first overall shape based on time-amplitude data of the sound pickup signal, a second overall shape calculation unit that calculates a second overall shape of the sound pickup signal by smoothing the first overall shape, and a time determination unit that determines a bottom time at some point from direct sound to initial reflected sound of the sound pickup signal and a peak time of the initial reflected sound based on at least one of the first overall shape and the second overall shape.

The signal processor may further include a search range determination unit that determines a search range for searching for the separation boundary point based on the bottom time and the peak time.

The signal processor may further include an evaluation function calculation unit that calculates an evaluation function based on the sound pickup signal in the search range and a separation boundary point calculation unit that calculates the separation boundary point based on the evaluation function.

A part or the whole of the above-described processing may be executed by a computer program. The above-described program can be stored and provided to the computer using any type of non-transitory computer readable medium. The non-transitory computer readable medium includes any type of tangible storage medium. Examples of the non-transitory computer readable medium include magnetic storage media (such as floppy disks, magnetic tapes, hard disk drives, etc.), optical magnetic storage media (e.g. magneto-optical disks), CD-ROM (Read Only Memory), CD-R, CD-R/W, DVD-ROM (Digital Versatile Disc Read Only Memory), DVD-R (DVD Recordable)), DVD-R DL (DVD-R Dual Layer)), DVD-RW (DVD ReWritable)), DVD-RAM), DVD+R), DVR+R DL), DVD+RW), BD-R (Blu-ray (registered trademark) Disc Recordable)), BD-RE (Blu-ray (registered trademark) Disc Rewritable)), BD-ROM), and semiconductor memories (such as mask ROM, PROM (Programmable ROM), EPROM (Erasable PROM), flash ROM, RAM (Random Access Memory), etc.). The program may be provided to a computer using any type of transitory computer readable medium. Examples of the transitory computer readable medium include electric signals, optical signals, and electromagnetic waves. The transitory computer readable medium can provide the program to a computer via a wired communication line such as an electric wire or optical fiber or a wireless communication line.

Although embodiments of the invention made by the present invention are described in the foregoing, the present invention is not restricted to the above-described embodiments, and various changes and modifications may be made without departing from the scope of the invention.

The present disclosure is applicable to a device for generating a filter to be used in out of head localization.

What is claimed is:

1. A filter generation device comprising:

a microphone configured to pick up a measurement signal output from a sound source and acquire a sound pickup signal; and a processing unit configured to generate a filter signal in accordance with transfer characteristics from the sound source to the microphone based on the sound pickup signal, wherein the processing unit includes:

an extraction unit configured to extract a first signal having a first number of samples from samples preceding a boundary sample of the sound pickup signal;

a signal generation unit configured to generate a second signal containing a direct sound from the sound source and having a second number of samples larger than the first number of samples based on the first signal;

a transform unit configured to transform the second signal into a frequency domain and generate a spectrum;

a correction unit configured to increase a value of the spectrum in a band equal to or lower than a specified frequency and generate a corrected spectrum;

an inverse transform unit configured to inversely transform the corrected spectrum into a time domain and generate a corrected signal; and a generation unit configured to generate the filter signal by using the sound pickup signal and the corrected signal, the generation unit generating a filter value preceding the boundary sample by a value of the corrected signal and generating a filter value subsequent to the boundary sample and having less than the second number of samples by a sum of the sound pickup signal and the corrected signal.

2. The filter generation device according to claim 1, wherein the sound pickup signal preceding the boundary sample contains direct sound reaching the microphone directly from the sound source, and the sound pickup signal subsequent to the boundary sample contains reflected sound reaching the microphone from the sound source after being reflected.

3. The filter generation device according to claim 1, wherein a frequency band corrected by the correction unit is defined by a first frequency higher than the specified frequency and a second frequency lower than the first frequency.

4. The filter generation device according to claim 1, wherein a microphone acquires a sound pickup signal containing direct sound directly reaching the microphone and reflected sound, the filter generation device includes a first overall shape calculation unit configured to calculate a first overall shape based on time-amplitude data of the sound pickup signal;

a second overall shape calculation unit configured to calculate a second overall shape of the sound pickup signal by smoothing the first overall shape;

a time determination unit configured to determine a bottom time at some point from direct sound to initial reflected sound of the sound pickup signal and a peak time of the initial reflected sound based on at least one of the first overall shape and the second overall shape;

a search range determination unit configured to determine a search range for searching for a separation boundary point based on the bottom time and the peak time;

an evaluation function calculation unit configured to calculate an evaluation function based on the sound pickup signal in the search range; and a separation boundary point calculation unit configured to calculate the separation boundary point based on the evaluation function, wherein the boundary sample is set based on the separation boundary point.

5. A filter generation method of generating a filter signal in accordance with transfer characteristics by picking up a measurement signal output from a sound source with use of a microphone, comprising:

a step of acquiring a sound pickup signal by using the microphone;

a step of extracting a first signal having a first number of samples from samples preceding a boundary sample of the sound pickup signal;

a step of generating a second signal containing a direct sound from the sound source and having a second number of samples larger than the first number of samples based on the first signal;

a step of transforming the second signal into a frequency domain and generating a spectrum;

a step of increasing a value of the spectrum in a band equal to or lower than a specified frequency and generating a corrected spectrum;

a step of inversely transforming the corrected spectrum into a time domain and generating a corrected signal; and a step of generating the filter signal by using the sound pickup signal and the corrected signal, the filter signal generating step generating a filter value preceding the boundary sample by a value of the corrected signal and generating a filter value subsequent to the boundary sample and having less than the second number of samples by a sum of the sound pickup signal and the corrected signal.

6. A non-transitory computer readable medium storing a program causing a computer to execute a filter generation method of generating a filter signal in accordance with transfer characteristics by picking up a measurement signal output from a sound source with use of a microphone, the filter generation method comprising:

a step of acquiring a sound pickup signal by using the microphone;

a step of extracting a first signal having a first number of samples from samples preceding a boundary sample of the sound pickup signal;

a step of generating a second signal containing a direct sound from the sound source and having a second number of samples larger than the first number of samples based on the first signal;

a step of transforming the second signal into a frequency domain and generating a spectrum;

a step of increasing a value of the spectrum in a band equal to or lower than a specified frequency and generating a corrected spectrum;

a step of inversely transforming the corrected spectrum into a time domain and generating a corrected signal; and a step of generating the filter signal by using the sound pickup signal and the corrected signal, the filter signal generating step generating a filter value preceding the boundary sample by a value of the corrected signal and generating a filter value subsequent to the boundary sample and having less than the second number of samples by a sum of the sound pickup signal and the corrected signal.

* * * * *